US008268524B2

(12) United States Patent
Oki et al.

(10) Patent No.: US 8,268,524 B2
(45) Date of Patent: Sep. 18, 2012

(54) BLACK TONER AND IMAGE FORMING METHOD

(75) Inventors: Masahiro Oki, Shiojiri (JP); Yoshihiro Ueno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 12/495,461

(22) Filed: Jun. 30, 2009

(65) Prior Publication Data

US 2010/0015543 A1 Jan. 21, 2010

(30) Foreign Application Priority Data

Jul. 18, 2008 (JP) ..... 2008-187235

(51) Int. Cl.
*G03G 9/00* (2006.01)

(52) U.S. Cl. ..... 430/108.22; 430/108.1; 430/108.21; 430/108.9

(58) Field of Classification Search ..... 430/108.1, 430/108.21, 108.22, 108.9, 137.1
See application file for complete search history.

(56) References Cited

U.S. PATENT DOCUMENTS 4,868,086 A * 9/1989 Ohtani et al. ..... 430/137.17
6,740,461 B2 * 5/2004 Yamashita et al. ..... 430/111.35
6,824,945 B2 * 11/2004 Emoto et al. ..... 430/137.15

FOREIGN PATENT DOCUMENTS

JP 01152165 A * 6/1989
JP 2001-201895 7/2001
JP 2001-281917 10/2001
JP 2002-162791 6/2002
JP 2005-049489 2/2005

OTHER PUBLICATIONS

English Abstract of JP-01152165A.*
English Translation of JP-01152165A.*

* cited by examiner

*Primary Examiner* — Mark F Huff
*Assistant Examiner* — Stewart Fraser
(74) *Attorney, Agent, or Firm* — DLA Piper LLP (US)

(57) ABSTRACT

A black toner includes: toner mother particles containing carbon black as a colorant and a binder resin, the toner mother particles being surface-modified with a polyalkyleneimine.

7 Claims, 6 Drawing Sheets

BLACK TONER AND IMAGE FORMING METHOD

BACKGROUND

1. Technical Field

The present invention relates to a black toner and an image forming method.

2. Related Art

An image forming apparatus employing an electrophotographic process, such as a printer, a duplicator and a facsimile machine, forms an image formed of a toner on a recording medium, such as paper, by a sequence of image forming process including charging, exposing, developing, transferring and fixing.

The image forming apparatus is equipped with a developing device having a developing roller having a toner supported thereon. The developing device has the developing roller that faces a photoreceptor drum having an electrostatic latent image, and the toner is applied to the photoreceptor drum from the developing roller, thereby visualizing (developing) the latent image on the photoreceptor drum as a toner image.

In general, a toner is electrically charged and then subjected to development. It is known that a charge controlling agent is used for charging the toner efficiently (as described, for example, in JP-A-2005-49489).

However, the known toner undergoes fluctuation in charging property among the toner particles, and even though a charge controlling agent is added, the fluctuation cannot be sufficiently suppressed, thereby providing a problem due to adverse effect on developing characteristics and transferring characteristics. In particular, a positively charged toner containing carbon black as a colorant significantly undergoes the problem, and thus, inversely charged particles cannot be suppressed from being formed to provide defects including fog and the like.

SUMMARY

An advantage of some aspects of the invention is to provide a black toner that is excellent in positive charge, and to provide an image forming method using the black toner.

The invention includes the following aspects.

According to an aspect of the invention, a black toner contains toner mother particles containing carbon black as a colorant and a binder resin, and the toner mother particles are surface-modified with a polyalkyleneimine.

It is preferred in the black toner according to the aspect of the invention that the polyalkyleneimine is polyethyleneimine.

It is preferred in the black toner according to the aspect of the invention that the polyalkyleneimine has a number average molecular weight of from 5,000 to 100,000.

It is preferred in the black toner according to the aspect of the invention that the binder resin contains a rosin resin.

It is preferred in the black toner according to the aspect of the invention that the rosin resin has a softening point of from 80 to 190° C.

It is preferred in the black toner according to the aspect of the invention that the rosin resin has a weight average molecular weight of from 500 to 100,000.

According to another aspect of the invention, an image forming method uses a black toner that contains toner mother particles containing carbon black as a colorant and a binder resin, and the toner mother particles are surface-modified with a polyalkyleneimine.

It is preferred in the image forming method according to the aspect of the invention that: the image forming method contains forming an image with an image forming apparatus; the image forming apparatus contains a latent image supporting member that supports a latent image, and a developing device that applies the black toner to the latent image supporting member to visualize the latent image as a toner image; the developing device contains a toner housing part that houses the black toner, and a developing roller that faces the latent image supporting member adjacently and has a relief structure on an outer circumference surface thereof for supporting the black toner; and the relief structure is formed by a rolling method.

According to some aspects of the invention, a black toner can be provided that is excellent in positive charge. According to other aspects of the invention, an image forming method can be provided that provides a high resolution and a high quality printed image while resolving problems associated with a small diameter toner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
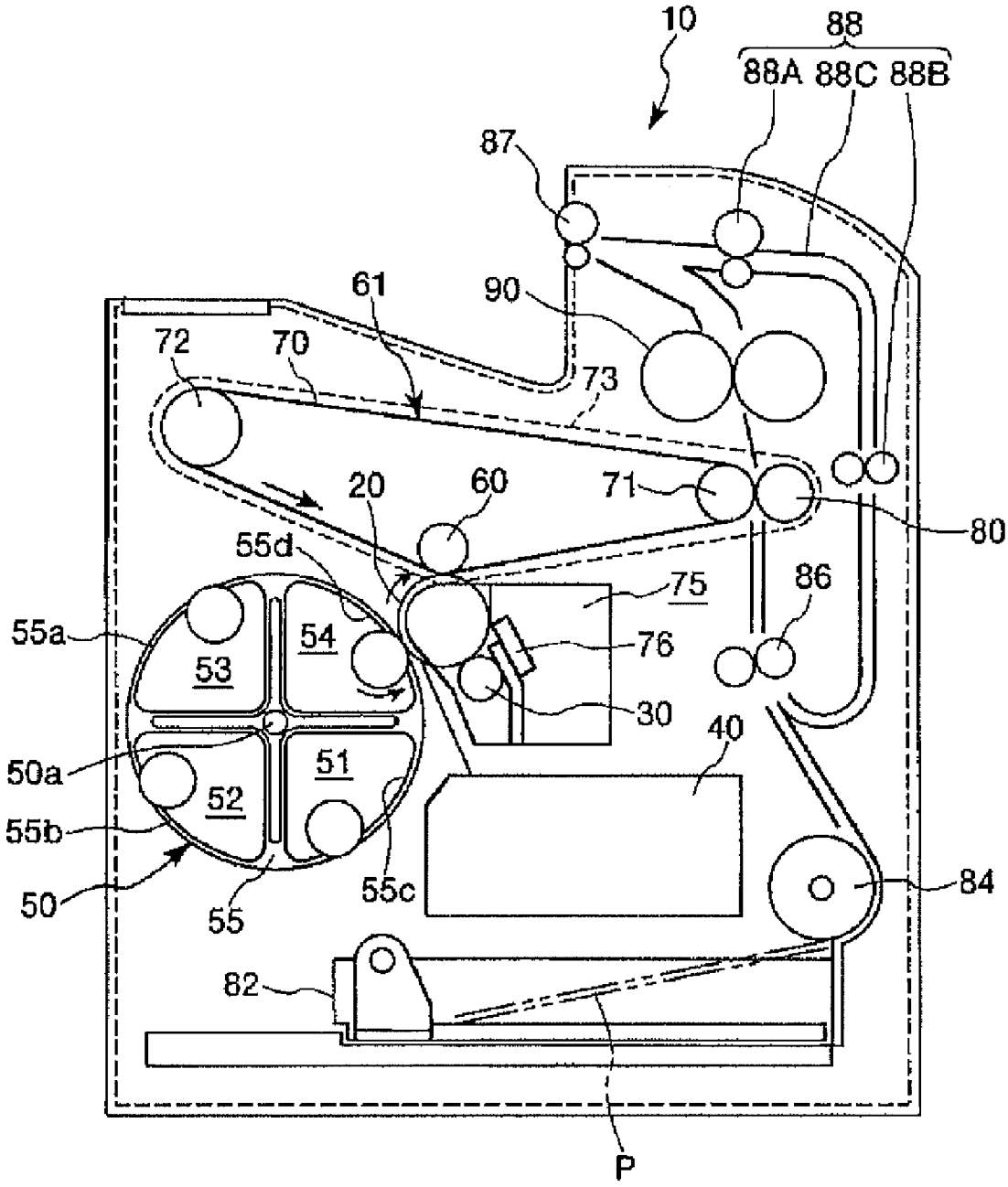
FIG. 1 is a schematic cross sectional view showing an example of a total structure of an image forming apparatus, to which a toner according to an aspect of the invention is applied.

A black toner and an image forming apparatus according to aspects of the invention will be described with reference to exemplary embodiments.

Black Toner

A black toner according to an aspect of the invention will be described.

The black toner (which may be hereinafter referred simply to as "toner") contains toner particles containing toner mother particles that are constituted by carbon black as a colorant and a binder resin, and the toner mother particles are surface-modified (chemically modified) with a polyalkyleneimine.

Toner Particles

Toner Mother Particles

The toner mother particles contain at least a binder resin (which may be hereinafter referred simply to as "resin material") and carbon black as a colorant.

1. Binder Resin

Toner mother particles are constituted by a material that contains, as a major component, a binder resin.

The binder resin used in the aspect of the invention is not particularly limited, and known resins may be used.

The toner mother particles preferably contain a rosin resin as the binder resin.

The rosin resin is advantageous for improving the fixing property of the toner to a recording medium, and is such a material that can be easily and securely modified (chemically modified) with a polyalkyleneimine described later. In other words, a rosin resin is a material that has a large number of functional groups (acidic groups) having high reactivity with a polyalkyleneimine described later. Accordingly, when a rosin resin is once modified with a polyalkyleneimine, the polyalkyleneimine is chemically bonded to the rosin resin, and thus the polyalkyleneimine is securely prevented from being desorbed or released from the modified rosin resin. Consequently, the toner can be improved in fixing property, and simultaneously the toner particles are improved in charging property of positive charge.

A rosin resin may be present only on a part of the surface of the toner mother particles, may be contained in the entire toner mother particles, may be localized on the surface of the toner mother particles, and may be present to cover the surface of the toner mother particles.

Examples of the rosin resin include a rosin-modified phenol resin, a rosin-modified maleic resin, a rosin-modified polyester resin, a fumaric acid-modified rosin resin and ester gum, which may be used solely or in combination of two or more kinds of them.

The rosin resin preferably has a softening point of from 80 to 190° C., more preferably from 80 to 170° C., and further preferably from 80 to 160° C. In the case where the softening point of the rosin resin is in the range, the charging characteristics of the toner are improved, and simultaneously both the fixing characteristics and the heat resistant storage stability of the toner are improved to high levels.

The rosin resin preferably has a weight average molecular weight of from 500 to 100,000, more preferably from 1,000 to 80,000, and further preferably from 1,000 to 50,000. In the case where the weight average molecular weight of the rosin resin is in the range, the charging characteristics of the toner are improved, and simultaneously both the fixing characteristics and the heat resistant storage stability of the toner are improved to high levels.

The rosin resin preferably has an acid value of 40 mgKOH/g or less, more preferably 30 mgKOH/g or less, and further preferably from 5 to 25 mgKOH/g. In the case where the acid value of the rosin resin is in the range, the surface of the toner mother particles can be further favorably chemically modified with a polyethyleneimine, whereby the charging characteristics of the toner are improved, and simultaneously both the fixing characteristics and the heat resistant storage stability of the toner are improved to high levels.

The content of the rosin resin in the resin material constituting the toner mother particles is preferably from 1 to 50% by weight, and more preferably from 5 to 40% by weight. In the case where the content of the rosin resin is in the range, the charging characteristics of the toner are improved, and simultaneously both the fixing characteristics and the heat resistant storage stability of the toner are improved to high levels.

The toner mother particles may contain a known resin other than the rosin resin.

It is particularly preferred that a resin material having an ester bond is used in combination with the rosin resin. The resin material having an ester bond tends to have a decreased compatibility with the rosin resin, thereby making the rosin resin present securely on the surface of the toner particles. As a result, the surface of the toner mother particles can be chemically modified with a larger amount of a polyalkyleneimine, thereby further improving the charging characteristics of the toner particles.

Examples of the resin material having an ester bond include a polyester resin, a styrene-acrylate ester copolymer and a methacrylic resin. Among these, a polyester resin is particularly preferably used. A polyester resin has high transparency, and when a polyester resin is used as the binder resin, a resulting image exhibits high coloring property. Furthermore, a polyester resin is particularly low in compatibility with the rosin resin, and thus the rosin resin securely undergoes phase separation in the toner mother particles, whereby the rosin resin can be efficiently present on the surface of the toner mother particles.

In the case where the toner mother particles contain a polyester resin, the polyester resin preferably has an acid value of from 5 to 20 mgKOH/g, and more preferably from 5 to 15 mgKOH/g.

In the case where the toner mother particles contain a polyester resin, the softening point of the polyester resin is not particularly limited, and is preferably from 50 to 130° C., more preferably from 50 to 120° C., and further preferably from 60 to 115° C. In the case where the softening point is in the range, the toner can be particularly improved in fixing characteristics. The term "softening point" referred herein means a temperature, at which softening is started, defined by a Koka flow tester (produced by Shimadzu Corporation) under measurement conditions of a temperature increasing rate of 5° C. per min and a die hole diameter of 1.0 mm.

2. Colorant

The toner mother particles contain carbon black as a colorant.

A black toner using carbon black has low charging characteristics as compared to toners using other colorants, and even when a charge controlling agent is used as in a known toner, it is difficult to achieve sufficient charging characteristics.

In the aspect of the invention, on the other hand, the toner mother particles are surface-modified with a polyalkyleneimine, whereby a black toner excellent in positive charge can be provided. Even in the case where multi-color printing is performed by using toners containing other colorants in combination, charging characteristics can be well balanced with respect to the toners of other colors, thereby providing a sharp image.

3. Other Components

The toner mother particles may contain other components than those described above. Examples of the components include wax and magnetic powder, which have been known in the art.

As the constitutional material (component) of the toner mother particles, such materials as zinc stearate, zinc oxide, cerium oxide, silica, titanium oxide, iron oxide, a fatty acid and a fatty acid metallic salt, may be used in addition to the components described above.

Polyalkyleneimine

As having been described above, the toner mother particles are surface-modified with a polyalkyleneimine. The surface modification with a polyalkyleneimine herein means that at least a part of amino groups of a polyalkyleneimine undergo chemical reaction with at least a part of acidic groups on the surface of the toner mother particles derived from the binder resin, thereby forming covalent bond (such as amide bond).

A polyalkyleneimine is a compound having high positive charging property owing to a large number of amino groups contained therein.

In a known toner that suffers fluctuation in charging property among the toner particles, even when a charge controlling agent is added therefore, the fluctuation cannot be sufficiently suppressed, but there is a problem that the developing characteristics and transferring characteristics are adversely affected thereby. The tendency is conspicuous in a toner using carbon black as a colorant.

Under the circumstances, the inventors have made earnest investigations in view of the problem, and as a result, have found that a toner excellent in charging characteristics (positive charging characteristics) can be provided by surface-modifying the toner mother particles with a polyalkyleneimine. Since the toner is excellent in charging characteristics, the toner is also excellent in such characteristics as development efficiency and transfer efficiency.

In other words, in the aspect of the invention, the surface of the toner mother particles is modified (chemically modified) with a polyalkyleneimine having positive charging property, whereby the aforementioned problem is suppressed from occurring while the advantages of the binder resin are sufficiently exhibited, so as to provide a toner that is excellent in positive charging characteristics.

The advantages of the aspect of the invention can be obtained by modifying the surface of the toner mother particles with a polyalkyleneimine, and cannot be obtained only by adding a polyalkyleneimine simply to a toner.

Examples of the polyalkyleneimine include polyethyleneimine, polypropyleneimine, polybutyleneimine and polyisopropyleneimine. Among these, polyethyleneimine is preferably used. By using the polyethyleneimine, the surface of the toner mother particles can be favorably modified chemically, thereby providing a toner having excellent positive charging characteristics.

The polyalkyleneimine preferably has a number average molecular weight of from 5,000 to 100,000, and more preferably from 10,000 to 80,000. In the case where the number average molecular weight of the polyalkyleneimine is in the range, the surface of the toner mother particles can be efficiently modified (chemically modified), and unintended aggregation of the toner particles can be effectively prevented from occurring owing to the steric hindrance of the relatively long molecular chain of the polyalkyleneimine.

Shape of Toner Particles

The toner particles constituted by the aforementioned materials preferably have an average particle diameter of from 0.5 to 4 μm, more preferably from 1 to 3 μm, and further preferably from 1 to 2.5 μm. In the case where the average particle diameter of the toner is in the range, the fluctuation in characteristics among the respective toner particles can be suppressed, whereby a resolution of a toner image formed with the toner can be sufficiently increased while maintaining total high reliability of the liquid developer. The term "average particle diameter" referred herein means an average particle diameter based on volume.

Other Components

A silicone oil and/or a fluorine oil may be externally added to the toner. The external addition of a silicone oil and/or a fluorine oil forms aggregated bodies as secondary particles of the toner mother particles owing to the liquid crosslinking force thereof, and the aggregated particles apparently behave like toner mother particles having a large particle diameter in a toner housing part and a developing roller of a developing device described later. Accordingly, the toner can be prevented from being scattered, and can be improved in transporting property.

The silicone oil contained in the toner is not particularly limited, and examples thereof include a hydrogen silicone oil, a phenylsilicone oil, an aminosilicone oil, an epoxysilicone oil, a carboxysilicone oil, polyether silicone oil, a hydrophilic silicone oil, a methacrylic silicone oil, a mercaptosilicone oil, a one-terminal reactive silicone oil, a higher alkoxysilicone oil and an alkylsilicone oil.

The fluorine oil contained in the toner is not particularly limited, and examples thereof include a perfluoropolyether and polytrifluorochloroethylene.

The total addition amount of the silicone oil and the fluorine oil is preferably from 0.05 to 2 parts by weight per 100 parts by weight of the toner mother particles. In the case where the total amount thereof is in the range, the toner particles can be moderately and homogeneously moistened, whereby the toner particles are prevented from being scattered, and the aggregated bodies thus formed can be prevented from fluctuating in particle diameter. As a result, the toner can be suppressed in fluctuation in characteristics including charging characteristics and developing characteristics, and such aggregated bodies (soft aggregated bodies) can be provided that are easily pulverized by a reciprocating motion between the developing roller and the photoreceptor drum upon non-contact jumping development described later.

In the case where the total amount of the silicone oil and the fluorine oil added to the toner mother particles is less than 0.05 part by weight, the toner mother particles are not softly aggregated to fail to provide aggregated bodies (secondary particles). In the case where the total amount of the silicone oil and the fluorine oil added to the toner mother particles exceeds 2 parts by weight, the toner mother particles are firmly aggregated to each other, and the resulting aggregated bodies (secondary particles) may not be pulverized by the reciprocating motion between the developing roller and the photoreceptor drum upon non-contact jumping development, thereby failing to enhance the resolution and the gradation of the printed image.

The toner may contain inorganic fine particles, such as titanium oxide, as an external additive. The addition of the inorganic particles improves the flowability of the toner and also particularly improves the charging characteristics thereof.

The inorganic fine particles are preferably subjected to a hydrophobic treatment, whereby the flowability and the charging characteristics of the toner can be further improved.

The hydrophobic treatment by be performed in a manner that is ordinarily employed by a skilled person in the art, such as a wet method and a dry method, by using such a material as a silane compound, e.g., aminosilane, hexamethyldisilazane and dimethyldichlorosilane; and a silicone oil, e.g., dimethylsilicone, methylphenylsilicone, a fluorine-modified silicone oil, an alkyl-modified silicone oil, an amino-modified silicone oil and an epoxy-modified silicone oil.

In the black toner of the aspect of the invention, the surface of the toner mother particles is modified with a polyalkyleneimine. In the case where the black toner of the aspect of the invention is used in combination with toners of other colors, such as cyan, yellow and magenta, the toner mother particles of the toners of other colors may be surface-modified with a polyalkyleneimine. In the case where the surface of the other toner is modified, the charging characteristics can be suppressed from being fluctuated among the toners corresponding to respective colors, and thus the bias setting in an image forming apparatus described later can be easily performed.

Production Method of Black Toner

Preferred embodiments of a production method of the black toner according to an aspect of the invention will be described.

The production method of the black toner according to the embodiment contains: preparation of a dispersion liquid having toner mother particles dispersed in an aqueous dispersion medium; and surface modification by mixing the dispersion liquid with a polyalkyleneimine to modify the surface of the toner mother particles with a polyalkyleneimine, thereby providing toner particles.

The process of the production method of the black toner will be described respectively.

Preparation of Dispersion Liquid (Aqueous Dispersion Liquid)

A dispersion liquid (aqueous dispersion liquid) having the toner mother particles dispersed in an aqueous dispersion medium is prepared.

The aqueous dispersion liquid may be produced by any method, and it is preferred to prepare the aqueous dispersion liquid as a suspension liquid in such a manner that includes preparation of a resin solution having a material constituting the toner mother particles, such as a binder resin, (mother particle material) dissolved in an organic solvent; preparation of an O/W emulsion liquid by adding an aqueous liquid to the resin solution to prepare an O/W emulsion liquid through a W/O emulsion liquid; integration by integrating the dispersoid contained in the O/W emulsion liquid to provide integrated particles; and removal of the organic solvent by removing the organic solvent contained in the integrated particles to form the toner mother particles. By employing the manner, the homogeneity in size and shape of the dispersoid contained in the aqueous dispersion liquid can be enhanced, whereby the particle size distribution of the toner particles finally obtained can be sharp, and the toner particles can be suppressed in fluctuation in characteristics. In the following description, a representative example of the production method of the aqueous dispersion liquid including the preparation of the resin solution, the preparation of the O/W emulsion liquid, the integration of the dispersoid and the removal of the organic solvent will be described.

Preparation of Resin Solution

A resin solution having the binder resin and the like dissolved in an organic solvent is prepared.

The resin solution thus prepared contains the materials constituting the toner mother particles, and an organic solvent described later.

The organic solvent is not particularly limited as far as it dissolves at least a part of the binder resin, and preferably has a boiling point that is lower than that of an aqueous liquid described later, whereby the organic solvent can be easily removed.

The organic solvent is preferably low in compatibility with the aqueous liquid (aqueous dispersion medium) described later, and for example, preferably has a solubility of 30 g or less per 100 g of the aqueous liquid at 25° C. By using the organic solvent having the compatibility, the dispersoid constituted by the mother particle materials can be finely dispersed stably in the O/W emulsion liquid (aqueous emulsion liquid) described later.

The composition of the organic solvent can be appropriately selected depending on the resin material, the composition of the colorant, the composition of the aqueous liquid (aqueous dispersion medium) and the like.

The organic solvent is not particularly limited, and examples thereof include a ketone solvent, such as methyl ethyl ketone (MEK), and an aromatic hydrocarbon solvent, such as toluene.

The resin solution can be prepared, for example, by mixing the binder resin, the colorant, the organic solvent and the like with a mixing machine. Examples of the mixing machine that can be used for preparing the resin solution include a high-speed mixing machine, such as DESPA (produced by Asada Iron Works Co., Ltd.), and T.K. Robomix and T.K. Homodisper 2.5 type blade (produced by Primix Corporation).

The temperature of the material upon mixing is preferably from 20 to 60° C., and more preferably from 30 to 50° C.

The solid content in the resin solution is not particularly limited, and is preferably from 40 to 75% by weight, more preferably from 50 to 73% by weight, and further preferably from 50 to 70% by weight. In the case where the solid content is in the range, a dispersoid constituting a dispersion liquid (aqueous dispersion liquid) described later can have a higher sphericity (i.e., a shape close to a true sphere), and thus the toner particles finally obtained can securely have a favorable shape.

Upon preparing the resin solution, all the constitutional components of the resin solution to be prepared are mixed simultaneously, or in alternative, only a part of the constitutional components of the resin solution to be prepared may be mixed to provide a mixture (master batch) in advance, and the mixture (master batch) may be mixed with the other components.

Preparation of O/W Emulsion Liquid

An aqueous liquid is then added to the resin solution to prepare an O/W emulsion liquid through a W/O emulsion liquid.

The aqueous liquid may contain water as a major component.

The aqueous liquid may contain, for example, a solvent that is excellent in compatibility with water (for example, having a solubility of 50 parts by weight or more per 100 parts by weight of water at 25° C.).

The aqueous liquid may contain an emulsion dispersant depending on necessity. The addition of an emulsion dispersant facilitates preparation of the aqueous emulsion. The emulsion dispersant is not particularly limited, and a known emulsion dispersant may be used.

Upon preparing the O/W emulsion liquid, for example, a basic substance may be used. The basic substance used neutralizes the functional group (such as a carboxyl group) of the binder resin, thereby improving the homogeneity of the shape, size and dispersibility of the dispersoid in the O/W emulsion liquid prepared. Consequently, the toner particles obtained has a sharp particle size distribution. The basic substance may be added to the resin solution or may be added to the aqueous liquid. The basic substance may be added plural times during the preparation of the O/W emulsion liquid.

Examples of the basic substance include sodium hydroxide, potassium hydroxide and ammonia, which may be used solely or in combination of two or more kinds thereof.

The amount of the basic substance used is preferably an amount corresponding to from 1 to 3 times the amount that is necessary for neutralizing the entire carboxyl groups of the binder resin (i.e., from 1 to 3 equivalents), and more preferably an amount corresponding to from 1 to 2 times the amount (i.e., from 1 to 2 equivalents). By adding the basic substance in such an amount, the dispersoid can be prevented from forming a body having an irregular shape, and the particle size distribution of the particles obtained by the integration described later can be made shape.

The aqueous liquid may be added to the resin solution in any method, and it is preferred that the aqueous liquid containing water is added to the resin solution while the resin solution is stirred. Specifically, it is preferred that the aqueous liquid is gradually added (added dropwise) to the resin solution while the resin solution is applied with a shearing force with a mixing machine or the like, whereby an emulsion liquid of W/O type (i.e., a W/O emulsion liquid) is formed and then subjected to phase inversion to an emulsion liquid of O/W type (i.e., an O/W emulsion liquid). According to the procedures, the homogeneity of the size and shape of the dispersoid contained in the O/W emulsion liquid can be enhanced, whereby the toner particles finally obtained can have a significantly sharp particle size distribution, and the toner particles can be significantly suppressed in fluctuation in characteristics among the toner particles.

Examples of the mixing machine that can be used for preparing the O/W emulsion liquid include a high-speed mixing machine, such as DESPA (produced by Asada Iron Works Co., Ltd.), T.K. Robomix and T.K. Homodisper 2.5 type blade (produced by Primix Corporation), Slasher (produced by Mitsui Mining Co., Ltd.) and Cavitron (produced by Eurotec, Ltd.), and a high-speed dispersing machine.

Upon adding the aqueous liquid to the resin solution, the resin solution is preferably stirred at a blade tip velocity of from 10 to 20 m/sec, and more preferably from 12 to 18 m/sec. In the case where the blade tip velocity is in the range, the O/W emulsion liquid can be efficiently obtained, and the fluctuation in shape and size of the dispersoid in the O/W emulsion liquid can be decreased, whereby the homogeneous dispersion property of the dispersoid can be enhanced while preventing excessively small particles and coarse particles of the dispersoid from being formed.

The solid content in the O/W emulsion liquid is not particularly limited, and is preferably from 5 to 55% by weight and more preferably from 10 to 50% by weight. In the case where the solid content is in the range, the productivity of the toner can be enhanced while surely preventing unintended aggregation of the dispersoid in the O/W emulsion liquid from occurring.

The temperature of the materials in the procedures is preferably from 20 to 60° C., and more preferably from 20 to 50° C.

Integration

Plural pieces of the dispersoid are then integrated to form integrated particles. The integration of the dispersoid generally proceeds in such a manner that the pieces of the dispersoid containing the organic solvent collide with each other and are integrated to each other.

The integration of the plural pieces of the dispersoid is performed by adding an electrolyte to the O/W emulsion liquid while the O/W emulsion liquid is stirred. According to the procedures, the integrated particles can be easily and securely produced. The particle diameter and the particle size distribution of the integrated particles can be easily and securely controlled by adjusting the amount of the electrolyte added.

The electrolyte is not particularly limited, and known organic or inorganic water-soluble salts and the like may be used solely or in combination of two or more kinds thereof.

The electrolyte is preferably a salt of a monovalent cation. The use of a salt of a monovalent cation makes the particle size distribution of the integrated particles sharp. The use of a salt of a monovalent cation can prevent coarse particles from being formed in this procedure.

The electrolyte is more preferably a sulfate salt (such as sodium sulfate and ammonium sulfate) or a carbonate salt, and is particularly preferably a sulfate salt. The particle diameter of the integrated particles can be easily controlled by using a sulfate salt or a carbonate salt.

The amount of the electrolyte added in this procedure is preferably from 0.5 to 3 parts by weight, and more preferably from 1 to 2 parts by weight, per 100 parts by weight of the solid content of the O/W emulsion liquid, to which the electrolyte is added. In the case where the amount of the electrolyte is in the range, the particle diameter of the integrated particles can be easily and securely controlled, and coarse particles can be securely prevented from being formed.

The electrolyte is preferably added in the form of an aqueous solution. In the case where the electrolyte is added as an aqueous solution, the electrolyte can be quickly dispersed over the entire O/W emulsion liquid, and the amount of the electrolyte added can be easily and securely controlled. Consequently, integrated particles that have an intended particle diameter and a sharp particle size distribution can be obtained.

In the case where the electrolyte is added in the form of an aqueous solution, the concentration of the electrolyte in the aqueous solution is preferably from 2 to 10% by weight, and more preferably from 2.5 to 6% by weight. In the case where the concentration of the electrolyte is in the range, the electrolyte can be dispersed more quickly over the entire O/W emulsion liquid, and the amount of the electrolyte added can be more securely controlled. Furthermore, by the addition in the form of an aqueous solution the content of water in the O/W emulsion liquid can be a favorable value after completing the addition of the electrolyte. Accordingly, the growing rate of the integrated particles after completing the addition of the electrolyte can be appropriately lowered in such an extent that the productivity is not impaired. Consequently, the particle diameter of the integrated particles can be further securely controlled, and unintended integration of the integrated particles can be securely prevented from occurring.

Upon adding the electrolyte in the form of an aqueous solution, the rate of addition of the electrolyte aqueous solution is preferably from 0.5 to 10 parts by weight per minute, and more preferably from 1.5 to 5 parts by weight per minute, per 100 parts by weight of the solid content contained in the O/W emulsion liquid, to which the electrolyte aqueous solution is added. In the case where the rate of addition is in the range, the concentration of the electrolyte in the O/W emulsion liquid can be prevented from suffering unevenness, whereby coarse particles can be securely prevented from being formed, and the particle size distribution of the integrated particles can be sharp. The addition of the electrolyte at a rate within the range facilitates control of the rate of integration, whereby the average particle diameter of the integrated particles can be easily controlled, and the productivity of the toner can be particularly enhanced.

The electrolyte may be added plural times. By adding the electrolyte plural times, the integrated particles that have an intended size can be easily and securely obtained, and the sphericity of the integrated particles obtained can be sufficiently large.

The electrolyte may be added under stirring the O/W emulsion liquid, whereby such integrated particles can be obtained that are considerably small in fluctuation of shape and size among the particles.

The O/W emulsion liquid can be stirred by using such a stirring blade as an anchor blade, a turbine blade, a Faudler blade, a full-zone blade, a max blend blade and a half-moon blade, and among these a max blend blade and a full-zone blade are preferably used. By using the blades, the electrolyte added can be dispersed and dissolved uniformly to securely prevent unevenness in concentration of the electrolyte from occurring, and the integrated particles once formed can be prevented from being broken while integrating the dispersoid efficiently. As a result, the integrated particles that are small in fluctuation in shape and particle diameter among the particles can be efficiently produced.

The blade tip velocity of the mixing blade is preferably from 0.1 to 10 m/sec, more preferably from 0.2 to 8 m/sec, and further preferably from 0.2 to 6 m/sec. In the case where the blade tip velocity is in the range, the electrolyte added can be uniformly dispersed and dissolved, whereby unevenness in concentration of the electrolyte can be securely prevented from occurring, and the integrated particles once formed can be prevented from being broken while integrating the dispersoid efficiently.

The resulting integrated particles preferably have an average particle diameter of from 0.5 to 5 μm, and more preferably from 1.5 to 3 μm. In the case where the particle diameter is in the range, the particle diameter of the toner particles finally obtained can be controlled securely to an intended value.

Removal of Organic Solvent

Thereafter, the organic solvent contained in the O/W emulsion liquid (particularly in the dispersoid) is removed. By removing the organic solvent, a dispersion liquid (aqueous dispersion liquid) having the toner mother particles dispersed in the aqueous dispersion medium can be obtained.

The organic solvent may be removed in any method, and can be removed, for example, by reducing the pressure. By the procedure, the organic solvent can be efficiently removed while preventing the constitutional materials, such as the resin material, from denaturing.

The temperature in this procedure is preferably a temperature that is lower than the glass transition point (Tg) of the resin material constituting the integrated particles.

This procedure may be performed in the state that a defoaming agent is added to the O/W emulsion liquid (dispersion liquid), whereby the organic solvent can be efficiently removed.

Examples of the defoaming agent include a mineral defoaming agent, a polyether defoaming agent and a silicone defoaming agent, and also include a lower alcohol, a higher alcohol, a fat, a fatty acid, a fatty acid ester and a phosphate ester.

The amount of the defoaming agent used is not particularly limited, and is preferably from 20 to 300 ppm by weight, and more preferably from 30 to 100 ppm by weight, based on the solid content in the O/W emulsion liquid.

In this procedure, at least a part of the aqueous liquid may be removed along with the organic solvent.

In this procedure, it is not necessary to remove the entire organic solvent (i.e., the total amount of the organic solvent contained in the dispersion liquid). Even in the case where the entire organic solvent is not removed, the organic solvent remaining can be sufficiently removed in the later process described later.

Rinsing (First Rinsing)

The toner mother particles thus obtained are then rinsed. By rinsing the toner mother particles, a dispersion liquid (aqueous dispersion liquid) containing the rinsed toner mother particles can be obtained.

By rinsing the toner mother particles, the organic solvent is contained as an impurity if any can be efficiently removed. By rinsing the toner mother particles, furthermore, the electrolyte, the basic substance and the acidic substance used in the preceding process and a salt formed through the acid-base reaction can be efficiently removed. As a result, the amount of the total volatile organic compounds (TVOC) in the toner particles finally obtained can be particularly decreased.

The rinsing can be performed, for example, in such a manner that the toner mother particles are separated from the aqueous liquid by solid-liquid separation, and the solid component (toner mother particles) is again dispersed (re-dispersion) in an aqueous liquid (aqueous dispersion medium). The solid-liquid separation and the re-dispersion may be performed repeatedly plural times. The toner mother particles are preferably rinsed until the electroconductivity of the supernatant of the dispersion liquid (slurry) having the solid component (toner mother particles) re-dispersed in the aqueous liquid (aqueous dispersion medium) reaches 20 μS/cm or less.

Surface Modification

The dispersion liquid (aqueous dispersion liquid) containing the toner mother particles is then mixed with a polyalkyleneimine to surface-modify the toner mother particles with the polyalkyleneimine, thereby providing toner particles.

The surface modification may be performed by mixing the aqueous dispersion liquid and the polyalkyleneimine, and is preferably performed in the state where the hydrogen ion exponent (pH) of the dispersion liquid (aqueous dispersion liquid) is adjusted to a range of from 2 to 8. By adjusting the pH to the range, the acid component of the resin, which has been in a salt structure through neutralization upon producing the particles, can be restored to the original acidic group (such as COOH), whereby the reaction between the acidic groups present on the surface of the toner mother particles and the polyalkyleneimine can be efficiently performed while preventing securely unintended denaturation of the constitutional materials of the toner mother particles from occurring, and thus the polyalkyleneimine can be firmly fixed to the surface of the toner mother particles. Consequently, the toner can be particularly improved in charging characteristics. The hydrogen ion exponent (pH) of the dispersion liquid (aqueous dispersion liquid) in this procedure is preferably from 2 to 8 as described above, and is more preferably from 2.5 to 6.5, and further preferably from 4 to 5. In the case where the pH is in the range, the aforementioned advantages can be further conspicuously exhibited.

The pH can be adjusted, for example, by adding 1N hydrochloric acid or the like to the dispersion liquid. After adjusting the pH, furthermore, the excessive acid component may be removed by rinsing the toner mother particles until the electroconductivity of the supernatant of the dispersion liquid (slurry) having the toner mother particles re-dispersed in the aqueous liquid (aqueous dispersion medium) reaches 20 μS/cm or less.

After mixing the dispersion liquid and the polyalkyleneimine, the mixture is preferably stirred for about from 1 to 3 hours. By stirring the mixture, the surface of the toner mother particles can be uniformly modified (chemically modified).

The mixture may be stirred at ordinary temperature, or may be stirred under heating the mixture to about from 30 to 40° C. By heating the mixture during stirring, the surface of the toner mother particles can be efficiently modified (chemically modified).

The amount of the polyalkyleneimine used in the surface modification is preferably from 0.1 to 10 parts by weight, more preferably from 0.3 to 6.0 parts by weight, and further preferably from 0.5 to 3.0 parts by weight, per 100 parts by weight of the amount of the resin constituting the toner mother particles. In the case where the amount of the polyalkyleneimine used is in the range, the positive charging characteristics of the toner finally obtained can be particularly improved while preventing securely such a problem as elution of the excessive polyalkyleneimine in the toner from occurring.

Rinsing (Second Rinsing)

The toner particles thus obtained are then rinsed.

By rinsing the toner particles, the polyalkyleneimine unreacted, the organic solvent and the like remaining as impurities if any can be efficiently removed. As a result, the amount of the total volatile organic compounds (TVOC) in the toner particles finally obtained can be particularly decreased, and the stability of the characteristics of the toner particles is also improved.

The polyalkyleneimine is firmly fixed to the toner mother particles as described above. Accordingly, the polyalkyleneimine can be securely prevented from being desorbed or released from the toner mother particles even when the toner particles are rinsed.

The rinsing can be performed, for example, in such a manner that the toner particles are separated from the aqueous liquid by solid-liquid separation, and the solid component (toner particles) is again dispersed (re-dispersion) in an aqueous liquid (aqueous dispersion medium). The solid-liquid separation and the re-dispersion of the solid component may be performed repeatedly plural times.

Drying

Thereafter, the toner particles can be obtained by drying. By drying the toner particles, the water content in the toner particles can be securely lowered sufficiently, and the characteristics, such as the storage stability, of the toner finally obtained can be particularly improved.

The toner particles can be dried, for example, by using a vacuum dryer (such as Ribocorn (produced by Okawara Corporation) and Nauta (produced by Hosokawa Micron Co., Ltd.)), a fluidized bed dryer (produced by Okawara Corporation), and the like.

Thereafter, the resulting toner particles are subjected to an external addition treatment depending on necessity to provide a toner according to the aspect of the invention.

The toner may be subjected to various treatments, such as a classification treatment and an external addition treatment, depending on necessity.

The classification treatment may be performed, for example, by using a sieve, an airflow classifier or the like.

Image Forming Method

An embodiment of the image forming method using a black toner according to an aspect of the invention will be described.

The image forming method according to the embodiment forms a toner image on a recording medium through charging, exposing, developing, transferring and fixing.

Image Forming Apparatus

An embodiment of an image forming apparatus, to which the image forming method using a black toner according to an aspect of the invention is applied will be described.

FIG. 1 is a schematic cross sectional view showing an example of a total structure of an image forming apparatus, to which a toner according to an aspect of the invention is applied.

The image forming apparatus 10 shown in FIG. 1 records an image on a recording medium through an image forming process including a sequence of exposing, developing, transferring and fixing. The image forming apparatus 10 has, as shown in FIG. 1, a photoreceptor drum (latent image supporting member) 20 that supports an electrostatic latent image and is revolved in the direction shown by the arrow in the figure, around which in the rotation direction thereof a charging unit 30, an exposing unit 40, a developing unit 50, an intermediate transfer body 61 and a cleaning unit 75 are disposed in this order. The image forming apparatus 10 has, at the lower part in FIG. 1, a paper feeding tray 82 housing a recording medium P, such as paper, and has, on the downstream side in the conveying direction of the recording medium P with respect to the paper feeding tray 82, the intermediate transfer body 61 and a fixing device 90 in this order. The image forming apparatus 10 has a conveying unit 88 that turns over the recording medium P having been fixed on one surface thereof by the fixing device 90 and then returns the recording medium P to a secondary transferring position described later for forming images on both surfaces of the recording medium P.

The photoreceptor drum 20 has a cylindrical electroconductive substrate (which is not shown in the figure) and a photoconductive layer (which is not shown in the figure) formed on the outer circumference surface of the substrate, and is rotatable on the axis thereof in the direction shown by the arrow in FIG. 1.

The charging unit 30 is a device that charges uniformly the surface of the photoreceptor drum 20 by corona discharge or the like.

The exposing unit 40 is a device that receives image information from a host computer, such as a personal computer, which is not shown in the figure, and radiates laser light corresponding to the image information on the photoreceptor drum 20 having been uniformly charged, thereby forming an electrostatic latent image.

The developing unit 50 has four developing devices including a black developing device 51, a magenta developing device 52, a cyan developing device 53 and a yellow developing device 54, and is a device that visualize the latent image as a toner image by using selectively the developing devices corresponding to the latent image on the photoreceptor drum 20. The black developing device 51 develops the latent image with a black (K) toner, the magenta developing device 52 develops with a magenta (M) toner, the cyan developing device 53 develops with a cyan (C) toner, and the yellow developing device 54 develops with a yellow (Y) toner.

In an aspect of the invention, a toner obtained by surface-modifying toner mother particles with a polyalkyleneimine described above is used as the black toner. It is preferred that the surface-modified toner is also used as the magenta toner, and it is more preferred that the surface-modified toner is used as the toners of all colors. By using the surface-modified toner, the fluctuation in charging characteristics among the toners corresponding to the colors can be sufficiently suppressed, and thus the bias setting in an image forming apparatus described later can be easily performed. Furthermore, the developing efficiencies of the toners corresponding to the colors can be equalized.

The YMCK developing unit 50 in this embodiment is rotatable, whereby the four developing devices 51, 52, 53 and 54 face the photoreceptor drum 20 respectively. Specifically, the YMCK developing unit 50 has a holding body 55 that is rotatable on a shaft 50*a*, and four holding members 55*a*, 55*b*, 55*c* and 55*d* of the holding body 55 hold the four developing devices 51, 52, 53 and 54, respectively. The developing devices 51, 52, 53 and 54 selectively face the photoreceptor drum 20 through rotation of the holding body 55 while maintaining the relative positional relationship thereof. The developing devices 51, 52, 53 and 54 will be described in detail later.

The intermediate transfer body 61 has an endless intermediate transfer belt 70, and the intermediate transfer belt 70 is stretched on a primary transfer roller 60, a driven roller 72 and a driving roller 71, and is rotatably driven by the rotation of the driving roller 71 in the direction shown by the arrow in FIG. 1 in a circumferential velocity that is substantially the same as that of the photoreceptor drum 20.

The primary transfer roller 60 is a device that transfers a monochrome toner image formed on the photoreceptor drum 20 to the intermediate transfer belt 70.

The intermediate transfer belt 70 supports at least one of toner images of black, magenta, cyan and yellow, and in the case, for example, where a full color image is to be formed, the toner images of four colors including black, magenta, cyan and yellow are sequentially transferred and superimposed on each other, thereby forming a full color image. In this embodiment, the driving roller 71 also functions as a backup roller for a secondary transfer roller 80 described later. The primary transfer roller 60, the driving roller 71 and the driven roller 72 are supported by a base body 73.

The secondary transfer roller 80 is a device that transfers a monochrome or full color toner image formed on the intermediate transfer belt 70 to the recording medium P, such as paper, film or cloth.

The fixing device 90 is a device that fixes the toner image as a permanent image to the recording medium P by fusion-bonding the toner image thereto through application of heat and pressure to the recording medium P having the toner image transferred thereon. The cleaning unit 75 has a cleaning blade 76 formed of rubber, which is in contact with the surface of the photoreceptor drum 20 between the primary transfer roller 60 and the charging unit 30, and is a device that removes the toner remaining on the photoreceptor drum 20 after transferring the toner image to the intermediate transfer belt 70 with the primary transfer roller 60, by scraping the remaining toner with the cleaning blade 76.

The conveying unit 88 has a conveying roller pair 88A and 88B that holds and conveys the recording medium P having been fixed on one surface thereof by the fixing device 90, and a conveying path 88C that guides the recording medium P conveyed with the conveying roller pair 88A and 88B, to a resist roller 86 while turning over the recording medium P. By using the conveying unit 88, the recording medium P having been fixed on one surface thereof by the fixing device 90 is turned over and returned to the secondary transfer roller 80 for forming images on both surfaces of the recording medium P.

The operation of the image forming apparatus 10 having the aforementioned structure will be described.

The photoreceptor drum 20, developing rollers (which are not shown in the figure) of the developing unit 50 and the intermediate transfer belt 70 are started to rotate by an instruction issued from a host computer (which is not shown in the figure). The photoreceptor drum 20 is revolved and successively charged with the charging unit 30 (charging).

The charged region of the photoreceptor drum 20 reaches the exposing position through rotation of the photoreceptor drum 20, and a latent image corresponding to image information of the first color, for example, a yellow (Y) image, is formed on the charged region by the exposure unit 40 (exposure).

The latent image formed on the photoreceptor drum 20 reaches the developing position through rotation of the photoreceptor drum 20 and is developed with the yellow toner by the yellow developing device 54 (development), and thus a yellow toner image is formed on the photoreceptor drum 20. In this operation, the YMCK developing unit 50 is configured to render the yellow developing device 54 face the photoreceptor drum 20 at the developing position.

The yellow toner image formed on the photoreceptor drum 20 reaches the primary transferring position (i.e., the position where the photoreceptor drum 20 and the primary transfer roller 60 face each other) through rotation of the photoreceptor drum 20, and is transferred (primarily transferred) to the intermediate transfer belt 70 with the primary transfer roller 60 (primary transfer). In this operation, the primary transfer roller Go is applied with a primary transfer voltage (primary transfer bias) having the opposite polarity to the charging polarity of the toner. During the operation, the secondary transfer roller 80 is detached from the intermediate transfer belt 70.

The similar operations as above for the first color are repeatedly performed for the second, third and fourth colors, whereby toner images of respective colors corresponding to image signals are transferred to the intermediate transfer belt 70 and superimposed on each other, and thus a full color toner image is formed on the intermediate transfer belt 70.

The recording medium P is conveyed from the paper feeding tray 82 to the secondary transfer roller 80 with a paper feeding roller 84 and the resist roller 86.

The full color toner image formed on the intermediate transfer belt 70 reaches the secondary transferring position (i.e., the position where the secondary transfer roller 80 and the driving roller 71 face each other) through rotation of the intermediate transfer belt 70, and is transferred (secondarily transferred) to the recording medium P with the secondary transfer roller 80 (secondary transfer). In this operation, the secondary transfer roller 80 is pressed onto the intermediate transfer belt 70 and applied with a secondary transfer voltage (secondary transfer bias).

The full color toner image transferred to the recording medium P is fixed to the recording medium P by fusion-bonding thereto through application of heat and pressure with the fixing device 90 (fixing). The recording medium P is then delivered to the exterior of the image forming apparatus 10 with a paper delivering roller pair 87.

After passing the photoreceptor drum 20 through the primary transfer position, the toner remaining on the surface of the photoreceptor drum 20 is scraped off with the cleaning blade 76 of the cleaning unit 75, and the photoreceptor drum 20 is prepared for charging for forming a next latent image. The toner having been scraped off is recovered to the remaining toner recovering unit in the cleaning unit 75.

In the case where images are formed on both surfaces of a recording medium, the recording medium P having been fixed on one surface thereof with the fixing device 90 is once held by the paper delivering roller pair 87, the paper delivering roller pair 87 is then reversely driven, and the conveying roller pair 88A and 88B is driven, thereby turning over the recording medium P and returning it to the secondary transfer roller 80 through the conveying path 88C. Thereafter, an image is formed on the other surface of the recording medium P in the similar procedures as above.

Developing Device

The developing device 54, which is an example of a developing device, to which the black toner according to an aspect of the invention is applied, will be described in detail with reference to the drawing. The developing devices 51, 52 and 53 are the same as the developing device 54 except that the color of the toner used is different, and therefore, the descriptions therefor are omitted.

Figure 2:
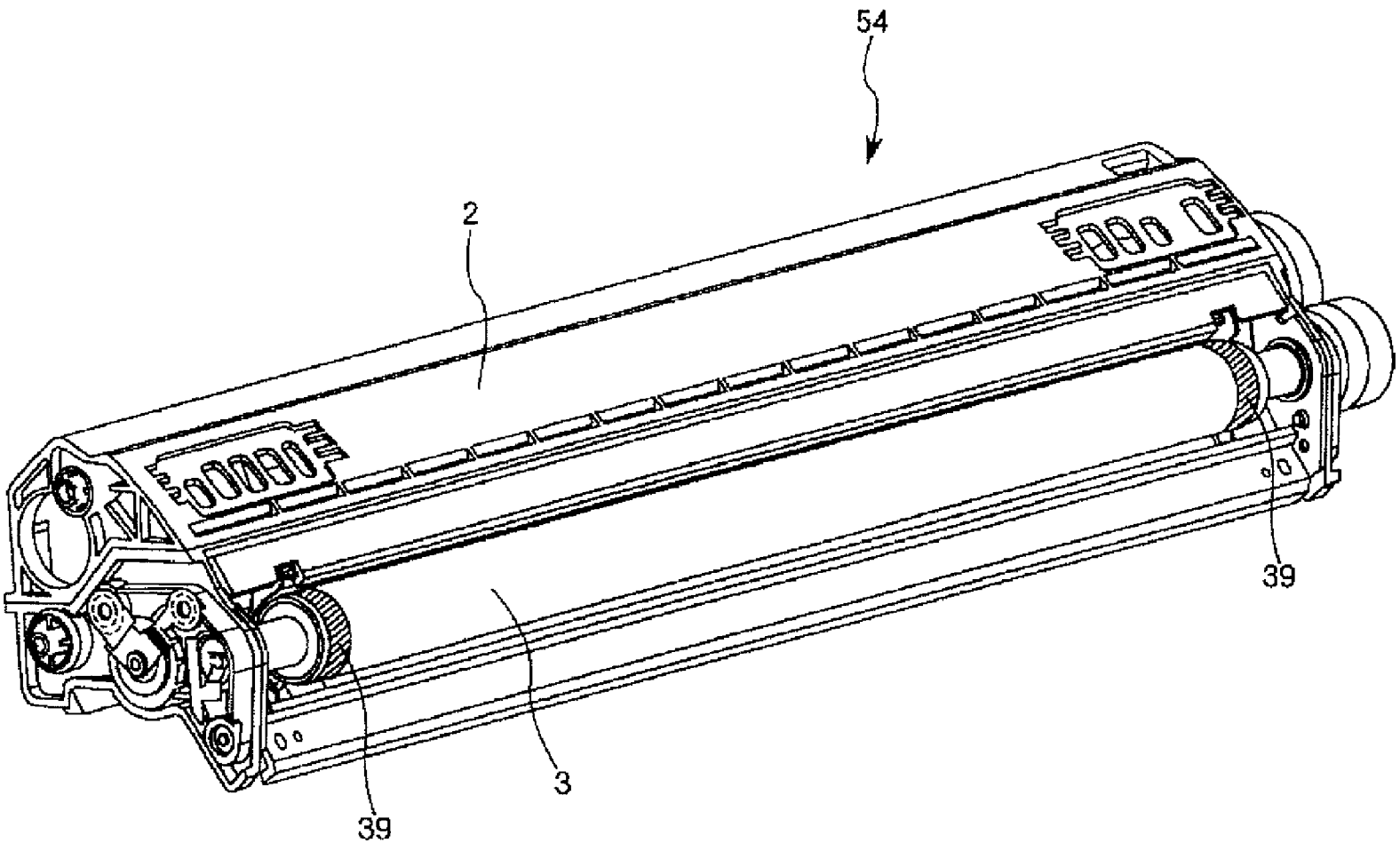
FIG. 2 is a perspective view showing a developing device installed in the image forming apparatus shown in FIG. 1.
Figure 3:
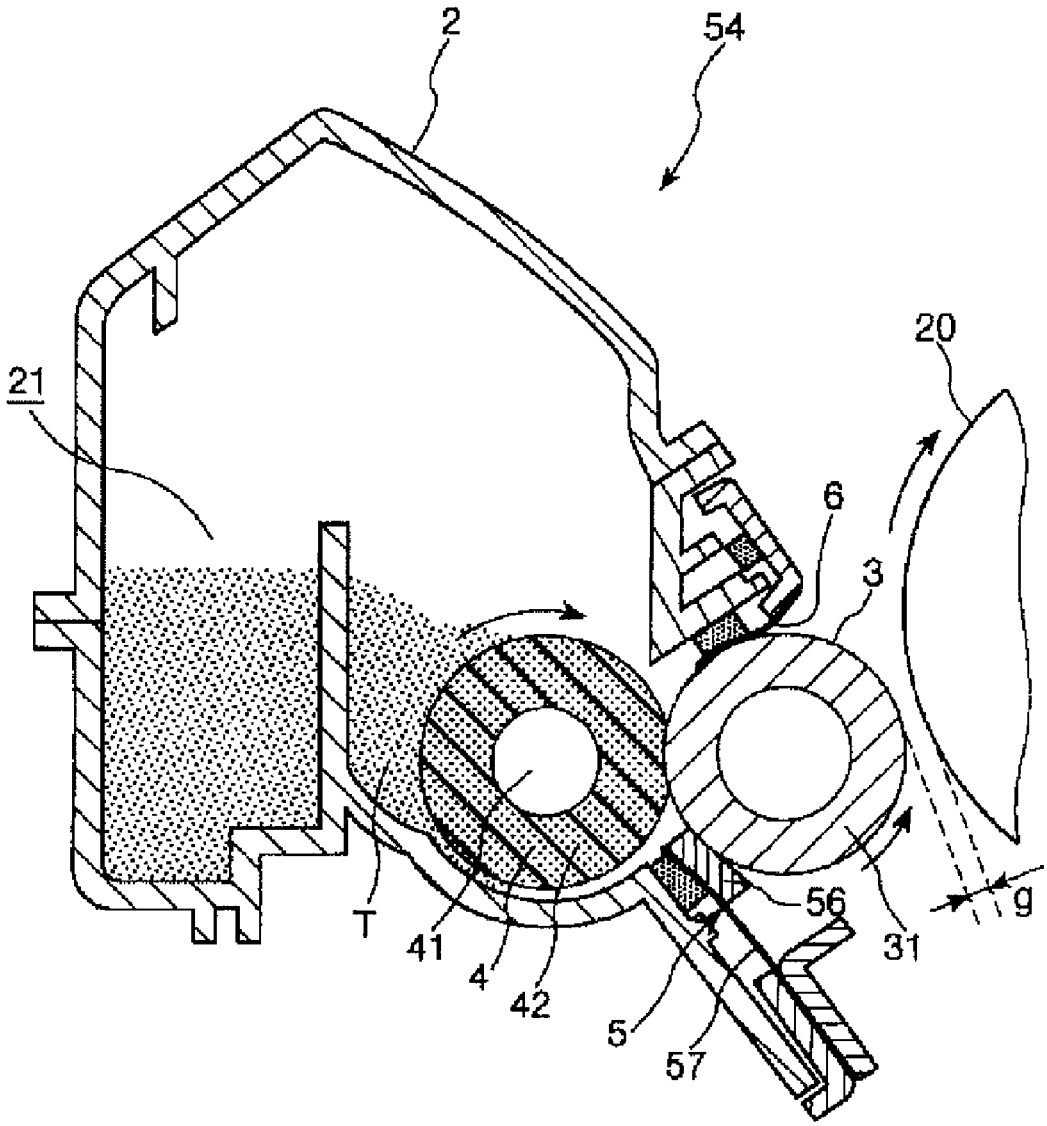
FIG. 3 is a schematic cross sectional view showing a schematic structure of the developing device shown in FIG. 2.

FIG. 2 is a perspective view showing a developing device installed in the image forming apparatus shown in FIG. 1, and FIG. 3 is a schematic cross sectional view showing a schematic structure of the developing device shown in FIG. 2.

As shown in FIG. 3, the developing device 54 has a housing 2 having formed therein a toner housing part 21 that houses a toner T (toner according to an aspect of the invention) as a developer, a developing roller 3 that supports the toner T, a toner feeding roller 4 that feeds the toner T to the developing roller 3, and a restricting blade 5 that restricts the thickness of the layer of the toner T supported on the developing roller 3.

The housing 2 houses the toner T in the toner housing part 21, which is formed as an inner space of the housing 2.

The housing 2 has an opening on the right side in FIG. 2, and the toner feeding roller 4 and the developing roller 3 are each rotatably supported in the vicinity of the opening. The housing 2 has the restricting blade 5. The housing 2 has a sealing member 6 for preventing the toner from being leaked between the housing 2 and the developing roller 3 at the opening.

The developing roller 3 transports the toner T to the developing position between the developing roller 3 and the photoreceptor drum 20 (which is hereinafter simply referred to as a developing position) while supporting the toner T on the outer circumference surface thereof. The developing roller 3 has a cylindrical shape and is rotatable on the axis thereof. In this embodiment, the developing roller 3 rotates in the inverse direction to the rotation direction of the photoreceptor drum 20. As shown in FIG. 2, a spacer 39 in the form of a tape is provided on the outer circumference surface of the developing roller 3 at the both ends thereof over the entire circumference thereof. The spacer 39 is pressed on the non-image supporting surface of the photoreceptor drum 20, thereby forming a developing gap g between the developing roller 3 and the photoreceptor drum 20. The developing gap g can be controlled to a desired size by the thickness of the spacer 39. The constitutional material of the spacer 39 is not particularly limited, and such a material is preferred that has elasticity and larger hygroscopicity than the developing roller 3. The spacer 39 and the developing roller 3 are preferably adhered to each other with an adhesive having elasticity. The developing roller 3 will be described in detail later.

Thus, the developing roller 3 and the photoreceptor drum 20 face each other in a non-contact state through the minute gap g. An alternating bias voltage (alternating electric field) is applied as a developing bias voltage between the developing roller 3 and the photoreceptor drum 20, whereby the toner T is made to fly from the developing roller 3 to the photoreceptor drum 20 to develop the latent image on the photoreceptor drum 20 as a toner image. Accordingly, the embodiment employs so-called non-contact jumping development. In the non-contact jumping development, the toner T flies reciprocally between the developing roller 3 and the photoreceptor drum 20 associated with the change in voltage of the alternating bias voltage (developing bias voltage).

The toner feeding roller 4 feeds the toner T from the toner housing part 21 through above the guide member to the developing roller 3. The toner feeding roller 4 has a main body 41 in the form of a cylinder or a cylindrical solid column, and an elastic porous layer 42 provided on the main body 41. The elastic porous layer 42 is formed of a polyurethane foamed material or the like and is in contact with the developing roller 3 under pressure while undergoing elastic deformation. In this embodiment, the toner feeding roller 4 rotates in the inverse direction to the rotation direction of the developing roller 3. The toner feeding roller 4 not only has a function of feeding the toner T to the developing roller 3, but also has a function of scraping off the toner T remaining on the developing roller 3 from the developing roller 3. The toner feeding roller 4 is applied with a voltage that is equivalent to the developing bias voltage applied to the developing roller 3.

The restricting blade 5 restricts the thickness of the layer of the toner T supported on the developing roller 3, and upon restricting, imparts charge to the toner T through frictional charging. The restricting blade 5 also functions as a sealing member that seals a gap between the housing 2 and the developing roller 3.

The restricting blade 5 has an elastic body 56 that is in contact with the developing roller along the axis direction of the developing roller 3, and a supporting member 57 that supports the elastic body 56. The elastic body 56 is constituted, for example, by silicone rubber, urethane rubber or the like as a major component. The supporting member 57 is, for example, a thin plate in a sheet form having spring characteristics (elasticity) of phosphor bronze, stainless steel or the like, and has a function of biasing the elastic body 56 to the developing roller 3.

In this embodiment, the restricting blade 5 is disposed in such a manner that the tip (free end) thereof is directed to the upstream side in the rotation direction of the developing roller 3, i.e., is in contact oppositely with the developing roller 3. In the developing device 54 in the embodiment, the excessive toner on the developing roller 3 is dropped downward with the restricting blade 5 and recovered into the toner housing part 21.

Developing Roller

The developing roller 3, which is an example of the developer supporting member, will be described in detail with reference to FIGS. 4 to 6.

Figure 4:
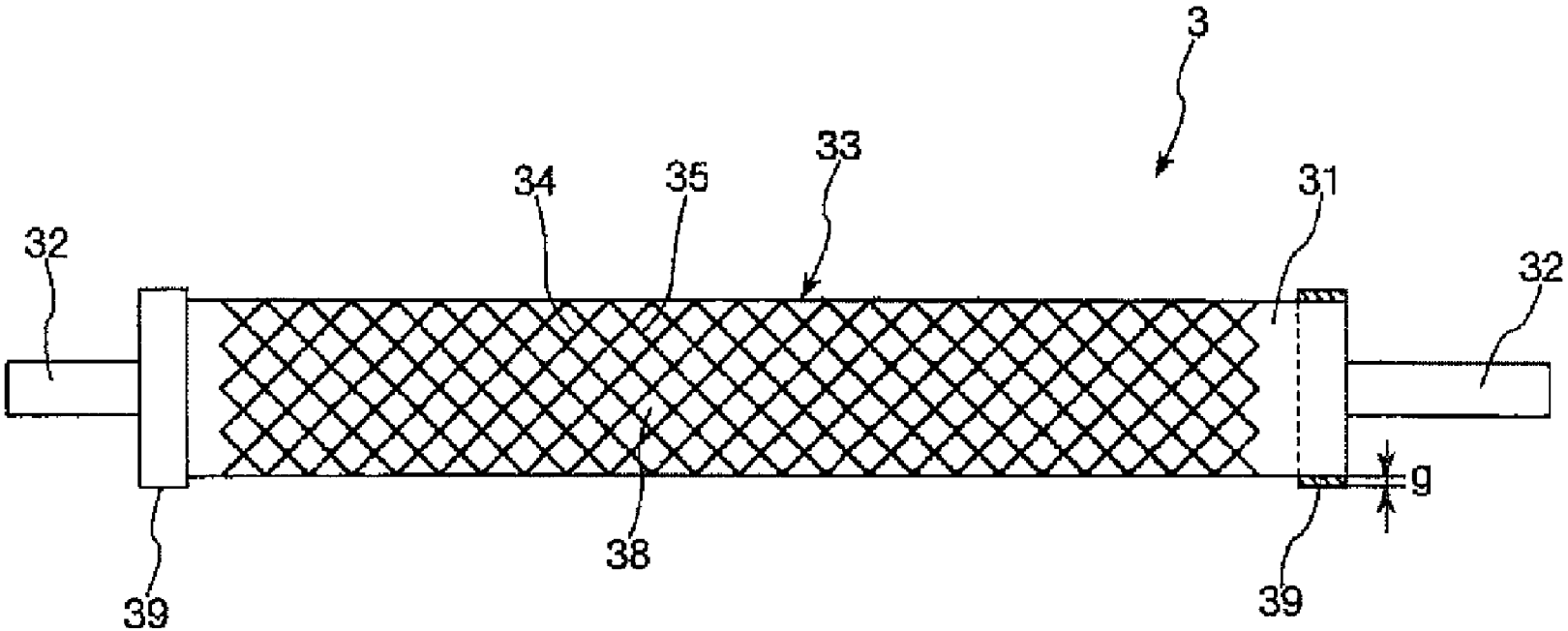
FIG. 4 is a plane view showing a schematic structure of a developing roller installed in the developing device shown in FIGS. 2 and 3.
Figure 5:
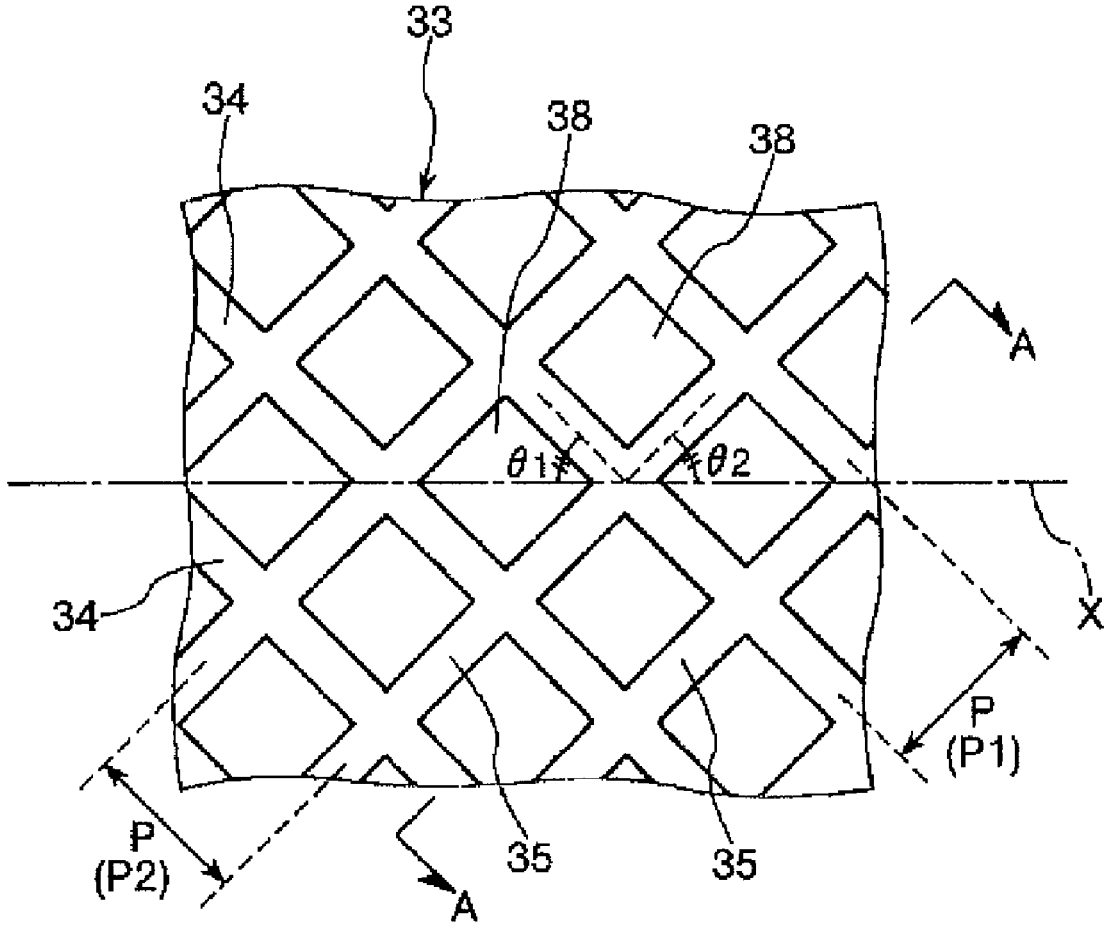
FIG. 5 is an enlarged view showing an outer circumference surface of the developing roller shown in FIG. 4.
Figure 6:
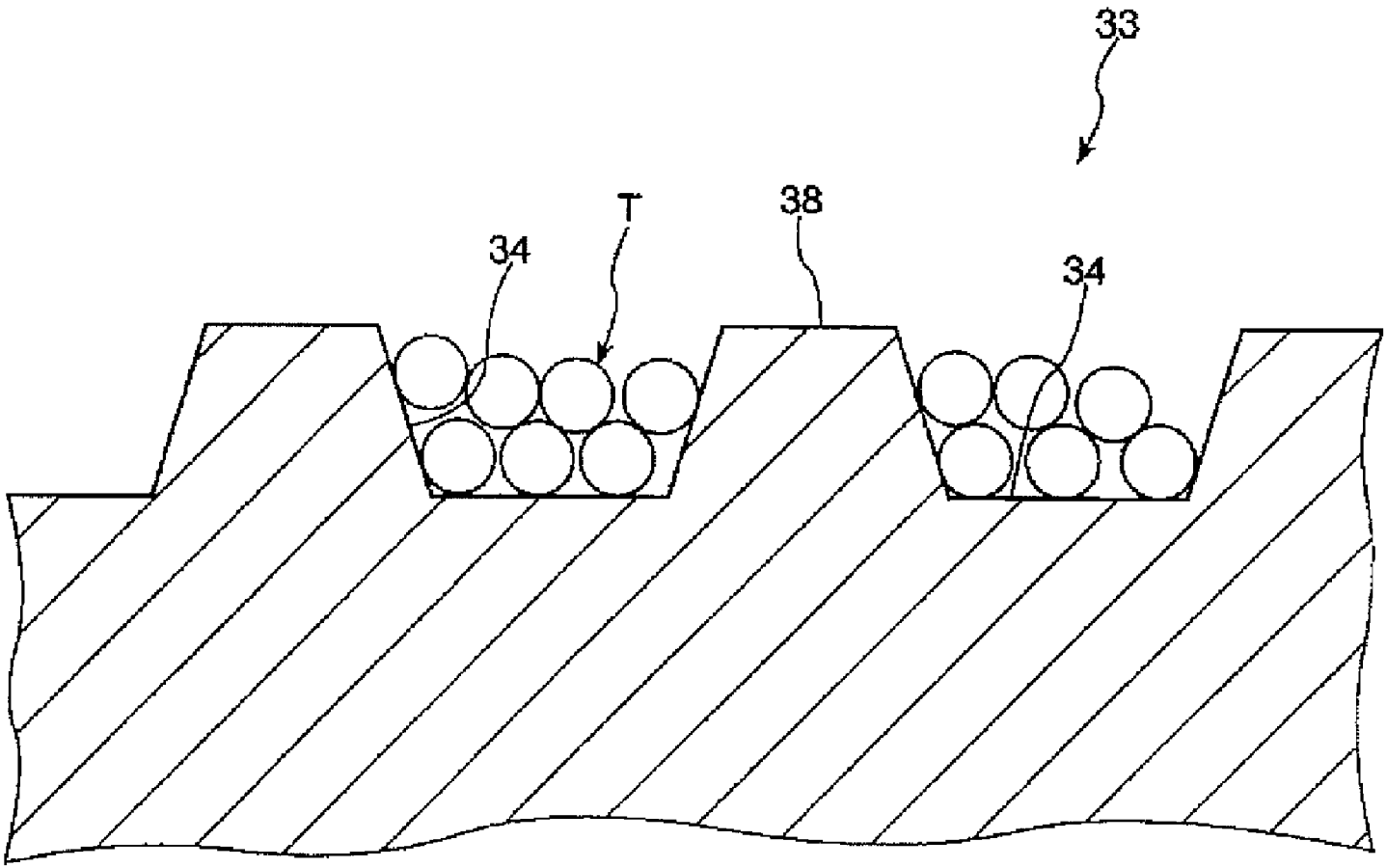
FIG. 6 is a cross sectional view on line A-A in FIG. 5.

FIG. 4 is a plane view showing a schematic structure of the developing roller installed in the developing device shown in FIGS. 2 and 3, FIG. 5 is an enlarged view showing an outer circumferential surface of the developing roller shown in FIG. 4, and FIG. 6 is a cross sectional view on line A-A in FIG. 5.

The developing roller 3 shown in FIG. 4 has a main body 31 in the form of a cylinder or a cylindrical solid column, and a pair of bearings 32 protruding from both ends of the main body 31.

The main body 31 has formed on the outer circumference surface thereof a relief structure 33 for supporting the toner as shown in FIG. 3.

The relief structure 33 is constituted by plural first grooves 34 that are substantially in parallel to each other and second plural grooves 35 that intersect with the first grooves and are substantially in parallel to each other as shown in FIG. 5. In the relief structure 33 thus constituted, a convex portion 38 is formed on an area that is surrounded by the two first grooves 34 (concave portions) adjacent to each other and the two second grooves 35 (concave portions) adjacent to each other.

More specifically, as shown in FIG. 4, the first grooves 34 are formed on the outer circumference surface of the main body 31 in a spiral form. In other words, as shown in FIG. 5, the first grooves 34 extend in a direction that is slanted from the line in parallel to the X axis on the outer circumference surface of the main body 31.

As shown in FIG. 6, the first grooves 34 each have a trapezoidal transversal cross sectional shape. The transversal cross sectional shape of the first grooves 34 is not limited thereto, and may be other shapes, such as a U-shape and a V-shape.

The second grooves 35 are formed on the outer circumference surface of the main body 31 in a spiral form that revolves in the opposite direction to the first grooves 34. In other words, the second grooves 35 extend in a direction that is slanted from the line in parallel to the X axis on the outer circumference surface of the main body 31. The second grooves 35 have the same structure as the first grooves 34 except that the extending direction thereof is different from that of the first grooves 34.

In this embodiment, the pitch of the first grooves 34 is the same as the pitch of the second grooves 35.

The extents of slant of the first grooves 34 and the second grooves 35 with respect to the line in parallel to the X axis on the outer circumference surface of the main body 31 are the same as each other. Specifically, as shown in FIG. 5, the slant angle θ1 between the first grooves 34 and the line in parallel to the X axis on the outer circumference surface of the main body 31 is the same as the slant angle θ2 between the second grooves 35 and the line in parallel to the X axis on the outer circumference surface of the main body 31.

The relief structure 33 is constituted by concave portions and/or convex portions that are arranged regularly and uniformly, whereby the toner can be homogeneously charged.

The relief structure 33 is constituted by the plural first grooves 34 and the plural second grooves 35, whereby concave portions and/or convex portions can be arranged regularly in a relatively simple structure. The relief structure 33 may be formed by a rolling method, thereby forming relatively easily and securely the relief structure 33 having concave portions and/or convex portions arranged regularly.

Since the relief structure 33 is formed regularly and uniformly, the relief structure 33 can support the toner T on the developing roller 3 uniformly in an optimum amount, and the rolling property (easiness in rolling) of the toner T on the outer circumference surface of the developing roller 3 can be homogeneous. As a result, the toner T can be effectively prevented from suffering local charging failure and local feeding failure, thereby providing excellent developing characteristics. Particularly, in the case where the surface-modified toner having been described above is used as the toner T, the advantages can be obtained conspicuously.

The relief structure 33 of the embodiment has a relatively large width of the tip of the convex portion 38, as compared to one produced by blasting, and thus has an excellent mechanical strength. In particular, the relief structure 33 is formed by such a process as rolling by using a mold, whereby the pressed portion is increased in strength and thus has an excellent mechanical strength as compared to one produced by such a process as cutting. The developing roller 3 having the relief structure 33 exhibits excellent durability even though it is frictioned with the restricting blade 5 and the toner feeding roller 4 described above. Accordingly, the developing roller 3 can be favorably applied to a developing device using a dry one-component non-magnetic toner. The relief structure 33 has the tip of the convex portion that suffers less shape change upon abrasion since the convex portion has a tip having a relatively large width, whereby the developing characteristics can be prevented from quickly deteriorate to provide excellent developing characteristics for a prolonged period of time.

The first grooves 34 and the second grooves 35 extend in directions slanted from the circumferential direction of the main body 31, and thus the toner on the relief structure 33 is conveyed while moving toward the both ends of the main body 31 associated with rotation of the developing roller 3. Accordingly, the toner can be prevented or suppressed from being localized on one side in the X axis direction of the main body 31.

The main body 31 of the developing roller 3 is constituted by a metallic material, such as aluminum, stainless steel and iron, as a major material. Particularly preferred examples of the material constituting the main body 31 include an iron material, such as STK and SGP, and an aluminum material, such as A6063 and A5056.

The outer circumference surface of the main body 31 may have nickel plating, chromium plating or the like.

The diameter (outer diameter) of the main body 31 is not particularly limited, and, for example, is preferably from 10 to 30 mm, and more preferably from 15 to 20 mm.

The pitch P of the first grooves 34 (P1) and the pitch P of the second grooves 35 (P2) are each preferably smaller than the average diameter of the pores of the elastic porous layer.

The pitch of the first grooves 34 and the pitch of the second grooves 35 are not particularly limited, and is preferably from 50 to 150 μm, and more preferably from 50 to 100 μm.

The pitch of the first grooves 34 (P1) and/or the pitch of the second grooves 35 (P2), which is represented by P, is preferably smaller than the pitch of the resolution used (i.e., the resolution of the image to be formed). More specifically, P is preferably less than 169 μm when the resolution is 150 dpi, preferably less than 127 μm when the resolution is 200 dpi, and preferably less than 85 μm when the resolution is 300 dpi. In the case where the pitch P is in the range, the toner image obtained by development can be prevented from suffering unevenness.

The depth of the first grooves 34 and/or the second grooves 35, i.e., the depth of the concave portion of the relief structure 33, is preferably larger than the volume average particle diameter of the toner particles of the toner T, and more preferably twice or less the volume average particle diameter of the toner particles of the toner T. In the case where the depth is in the range, the toner can be improved in charging characteristics.

The ratio D/d of the depth D of the first grooves 34 and/or the second grooves 35 and the average particle diameter d of the toner T (developer) is preferably from 0.5 to 2, and more preferably from 0.9 to 1.3. In the case where the ratio D/d is in the range, the resulting developing roller 3 can support the toner T uniformly in an optimum amount with the relief structure 33 thereof. In the case where the ratio D/d is less than the lower limit of the range, while depending on the shape of the relief structure 33 or the like, it may be difficult to pick up the toner T with the convex portions of the relief structure 33, whereby the toner may be deteriorated in rolling property to cause charging failure. In the case where the ratio D/d exceeds the upper limit of the range, while depending on the shape of the relief structure 33 or the like, the toner inside the grooves (inside the convex portions of the relief structure 33) may not in contact with both the developing roller 3 and the restricting blade 5 to cause charging failure.

The ratio W/d of the width of the first grooves 34 (W1) and/or the width of the second grooves 35 (W2), which is represented by W, and the average particle diameter d of the toner T (developer) is preferably from 2 to 20, and more preferably from 4 to 10. In the case where the ratio W/d is in the range, the developing roller 3 can support the toner T uniformly in an optimum amount with the relief structure 33 thereof. In the case where the ratio W/d is less than the lower limit of the range, while depending on the shape of the relief structure 33 or the like, the toner may not enter in the grooves, whereby the toner may be deteriorated in rolling property to cause charging failure, and even when the toner enters in the grooves, the toner may be accumulated in the grooves to cause tendency of filming. In the case where the ratio W/d exceeds the upper limit of the range, while depending on the shape of the relief structure 33 or the like, the amount of the toner supported by the developing roller 3 is decreased to cause conveying failure, and the toner may be reduced in opportunity for being in contact with the convex portions of the relief structure 33, thereby deteriorating the rolling property to cause charging failure.

The width of the first grooves 34 and the width of the second grooves 35 may be the same as or different from each other.

The preferred embodiments of the toner and the image forming method according to some aspects of the invention have been described, but the invention is not limited to them.

In the embodiments, the description has been made in such a manner that an aqueous emulsion liquid is obtained, and an electrolyte is added to the aqueous emulsion liquid to provide integrated particles, but the invention is not limited to the descriptions. For example, the integrated particles may be prepared by an emulsion polymerization and association method, in which a colorant, a monomer, a surfactant and a polymerization initiator are dispersed in an aqueous liquid, from which an aqueous emulsion liquid is prepared by emulsion polymerization, and an electrolyte is added to the aqueous emulsion liquid for association, or the integrated particles may be prepared by spray-drying the resulting aqueous emulsion liquid.

The components constituting the image forming apparatus may be each replaced by an arbitrary structure that can exhibit the equivalent function. An arbitrary structure may be added to the image forming apparatus.

EXAMPLES (1) Production of Liquid Developer

A liquid developer was produced in the following manner. The process described without temperature was performed at room temperature (25° C.).

Example 1

Preparation of Dispersion Liquid (Preparation of Aqueous Dispersion Liquid)

Preparation of Colorant Master 60 parts by weight of a polyester resin (acid value: 10 mgKOH/g, glass transition point (Tg): 55° C., softening point: 107° C.) was prepared as a resin material (binder resin).

A mixture of the resin material and carbon black (Printex L, produced by Degussa AG) as a colorant (mass ratio: 60/40) was prepared. The components were mixed with a 20-L Henschel mixer to provide a raw material for producing a toner.

The raw material (mixture) was kneaded with a twin-screw kneading and extruding machine. The kneaded product extruded from the extrusion port of the twin-screw kneading and extruding machine was cooled.

The kneaded product thus cooled was coarsely pulverized with a hammer mill to provide a colorant master batch having an average particle diameter of 1.0 mm or less.

Preparation of Wax Master Solution 100 parts by weight of a 50% MEK (methyl ethyl ketone) solution of the polyester resin, 16.7 parts by weight of carnauba wax (TOWAX-125, produced by Toa Kasei Co., Ltd.), 3.3 parts by weight of a wax dispersant (Disperbyk-108, produced by BYK Japan Co., Ltd.) and 80 parts by weight of MEK were dispersed with a bead mill dispersing machine (Starmill Model DMR110, produced by Ashizawa Finetech, Ltd.) to provide a wax dispersion liquid.

Preparation of Resin Solution 112.5 parts by weight of the colorant master batch was mixed with 106.4 parts by weight of MEK, 40.9 parts by weight of the polyester resin, 48.1 parts by weight of a high molecular weight polyester resin (acid value: 10 mgKOH/g, glass transition point (Tg): 65° C., softening point: 175° C.), 48.1 parts by weight of a rosin-modified polyester resin (Trafix 4102, a trade name, produced by Arakawa Chemical Industries, Ltd., acid value: 15 mgKOH/g, softening point: 98 to 108° C., weight average molecular weight: 1,600) and 144 parts by weight of the wax dispersion liquid were mixed with a high-speed dispersing machine (T.K. Robomix and T.K. Homodisper 2.5 type blade, produced by Primix Corporation), to which 1.38 parts by weight of Neogen SC-F (produced by Daiichi Kogyo Seiyaku Co., Ltd.) as an emulsifier was added to prepare a resin solution. In the resin solution, the pigment as the colorant was homogeneously dispersed.

Preparation of O/W Emulsion Liquid 63.7 parts by weight of 1N aqueous ammonia was added to the resin solution in a vessel, and the mixture was sufficiently stirred with a high-speed dispersing machine (T.K. Robomix and T.K. Homodisper 2.5 type blade, produced by Primix Corporation) at a blade tip velocity of the stirring blade adjusted to 7.5 m/sec. The temperature of the solution in a flask was adjusted to 25° C., and 400 parts by weight of deionized water was added dropwise to the mixture while stirring at a blade tip velocity of the stirring blade adjusted to 14.7 m/sec. 100 parts by weight of deionized water was further added to the mixture under continuous stirring to prepare an O/W emulsion liquid having a dispersoid containing the resin material dispersed therein through a W/O emulsion liquid.

Integration

The O/W emulsion liquid was placed in a stirring vessel having a max blend blade, and the temperature of the O/W emulsion liquid is controlled to 25° C. under stirring at a blade tip velocity of the stirring blade adjusted to 1.0 m/sec. 200 parts by weight of a 5.0% sodium sulfate aqueous solution was added dropwise to the emulsion liquid while maintaining the temperature and the stirring conditions, thereby performing integration of the dispersoid to form integrated particles. After completing the dropwise addition, the emulsion liquid was continuously stirred until the 50% volume average particle diameter Dv(50) (μm) of the integrated particles reached 3.5 μm. After the Dv(50) of the integrated particles reached 3.5 μm, 200 parts by weight of deionized water was added to complete the integration.

Removal of Organic Solvent

The O/W emulsion liquid containing the integrated particles was placed in an environment under reduced pressure to remove the organic solvent until the solid content reached 23% by weight, thereby providing a slurry (dispersion liquid) of toner mother particles.

Rinsing (First Rinsing)

The slurry (dispersion liquid) was subjected to solid-liquid separation, and the toner mother particles were subjected repeatedly to re-dispersion (re-slurry) in water and solid-liquid separation to perform rinsing. The rinsing was repeated until the electroconductivity of the supernatant of the slurry reached 20 μS/cm or less.

Thereafter, a wet cake of the toner mother particles was obtained by suction filtration, and the wet cake was dispersed in water to provide a dispersion liquid (aqueous dispersion liquid) containing the rinsed toner mother particles.

Surface Modification 1N hydrochloric acid was added to the dispersion liquid (aqueous dispersion liquid) containing the rinsed toner mother particles to adjust the hydrogen ion exponent (pH) thereof to 4.0.

Thereafter, polyethyleneimine (average molecular weight: 70,000) was added dropwise to the dispersion liquid (aqueous dispersion liquid) having a hydrogen ion exponent (pH) adjusted to 4.0 under stirring. The polyethyleneimine was added to make an amount thereof of 1.0 part by weight per 100 parts by weight of the amount of the resins constituting the particles. Furthermore, the mixture was sufficiently mixed to make a sufficiently homogeneous composition throughout the dispersion liquid.

Rinsing (Second Rinsing)

The dispersion liquid having the toner particles dispersed therein was subjected to solid-liquid separation, and the toner particles were subjected repeatedly to re-dispersion (re-slurry) in water and solid-liquid separation to perform rinsing. Thereafter, a wet cake of the toner particles (toner particle cake) was obtained by suction filtration. The wet cake thus obtained had a water content of 35% by weight. The liquid phase (supernatant) separated through the solid-liquid separation was investigated, but polyethyleneimine was not detected therein.

Drying

The resulting wet cake was dried with a vacuum dryer to provide toner particles (black toner) having the toner mother particles surface-modified (chemically modified) with polyethyleneimine.

A magenta toner, a yellow toner and a cyan toner were produced in the same manner as in the production of the black toner except that the carbon black was changed to a magenta pigment (Pigment Red 238, produced by Sanyo Color works, Ltd.), a yellow pigment (Pigment Yellow 180, produced by Clariant Japan Co., Ltd.) and a cyan pigment (Pigment Blue 15:3, produced by Dainichiseika Color & Chemicals Mfg. Co., Ltd.), respectively.

Examples 2 to 13

Toners corresponding to the colors were produced in the same manner as in Example 1 except that the kind of the rosin resin, the kind of the binder resin other than the rosin resin, the kind and amount of the polyalkyleneimine, and the hydrogen ion exponent (pH) of the dispersion liquid (aqueous dispersion liquid) having been adjusted in hydrogen ion exponent (pH) upon subjecting to the surface modification were changed to those shown in Table 1.

Example 14

Toners corresponding to the colors were produced in the same manner as in Example 1 except that after providing the toner particles in the manner as in Example 1, the resulting toner particles were subjected to the following process.

External Addition 2 parts by weight of negatively charged silica fine particles, RX200 (produced by Nippon Aerosil Co., Ltd., average particle diameter: 12 nm, treated with hexamethylsilazane) and 1.5 parts by weight of negatively charged silica fine particles, RX50 (produced by Nippon Aerosil Co., Ltd., average particle diameter: 40 nm, treated with hexamethylsilazane) were added to 100 parts by weight of the resulting toner particles, and after stirring the mixture with a 1-L mixing machine, 7012S, produced by Waring Commercial, Inc., at 10,000 rpm for 3 minutes, 0.5 part by weight of a dimethylsilicone oil (KF-96-200CS, produced by Shin-Etsu Chemical Co., Ltd.) as a silicone oil was added thereto, followed by stirring in the same manner at 10,000 rpm for 1 minute, thereby preparing a toner.

Example 15

Toners were produced in the same manner as in Example 14 except that the amount of the silicone oil added was changed as shown in Table 1.

Example 16

Toners were produced in the same manner as in Example 14 except that the silicone oil was changed to perfluoropolyether (Barrierta J25V, produced by NOK Corporation) as a fluorine oil.

Example 17

Toners were produced in the same manner as in Example 16 except that the amount of the fluorine oil added was changed as shown in Table 1.

Example 18

A black toner and a magenta toner were produced in the same manner as in Example 1, and toners of the other colors were produced in the same manner as in Example 1 except that the surface modification was not performed.

Comparative Example 1

Toners corresponding to the colors were produced in the same manner as in Example 1 except that the surface modification was not performed.

Comparative Example 2

Toners corresponding to the colors were produced in the same manner as in Example 1 except that the surface modification was not performed, and 1.5 parts by weight of aluminum stearate as a charge controlling agent (produced by NOF Corporation) was added to 100 parts by weight of the toner particles.

The kind and the content of the binder resin used for producing the toner, the kind of the polyalkyleneimine, the presence of the surface modification, the hydrogen ion exponent (pH) of the dispersion liquid (aqueous dispersion liquid) having been adjusted in hydrogen ion exponent (pH) upon subjecting to the surface modification (adjusted pH of the dispersion liquid) and the amount of the silicone oil or the fluorine oil added of Examples and Comparative Examples are shown in Table 1. In Table 1, the polyester resin (acid value: 10 mgKOH/g, glass transition point (Tg): 55° C., softening point: 107° C.) is abbreviated as PES, the styrene-acrylate ester copolymer is abbreviated as ST-AC, the rosin-modified polyester resin (Trafix 4102, a trade name, produced by Arakawa Chemical Industries, Ltd., acid value: 15 mgKOH/g, softening point: 98 to 108° C., weight average molecular weight: 1,600) is abbreviated as RPES, the rosin-modified phenol resin (Tamanol 135, a trade name, produced by Arakawa Chemical Industries, Ltd., acid value: 18 mgKOH/g, softening point: 130 to 140° C., weight average molecular weight: 15,000) is abbreviated as RPH, the rosin-modified maleic resin (Malkyd No. 1, a trade name, produced by Arakawa Chemical Industries, Ltd., acid value: 20 mgKOH/g, softening point: 127° C., weight average molecular weight: 3,100) is abbreviated as RM, and polyethyleneimine is abbreviated as PEI. In Table 1, the black toner is shown as B, the magenta toner is shown as M, the yellow toner is shown as Y, and the cyan toner is shown as C.

TABLE 1

| | Toner Toner mother particles | | | | | | | |
|---|---|---|---|---|---|---|---|---|
| | Resin material | | | | | | | |
| | Rosin resin | | Resin material other than rosin resin | | Presence of surface modification with polyalkyleneimine | | | |
| | Kind | Content in resin material (% by weight) | Kind | Content in resin material (% by weight) | B | M | Y | C |
| Example 1 | RPES | 20 | PES | 80 | yes | yes | yes | yes |
| Example 2 | RPES | 20 | PES | 80 | yes | yes | yes | yes |
| Example 3 | RPES | 20 | PES | 80 | yes | yes | yes | yes |
| Example 4 | RPES | 20 | PES | 80 | yes | yes | yes | yes |
| Example 5 | RPES | 20 | PES | 80 | yes | yes | yes | yes |
| Example 6 | RPES | 20 | PES | 80 | yes | yes | yes | yes |
| Example 7 | RPES | 20 | PES | 80 | yes | yes | yes | yes |
| Example 8 | RPES | 45 | PES | 55 | yes | yes | yes | yes |
| Example 9 | RPH | 20 | PES | 80 | yes | yes | yes | yes |
| Example 10 | RM | 20 | PES | 80 | yes | yes | yes | yes |
| Example 11 | RPES | 20 | ST-AC | 80 | yes | yes | yes | yes |
| Example 12 | RPES | 20 | PES | 80 | yes | yes | yes | yes |
| Example 13 | RPES | 20 | PES | 80 | yes | yes | yes | yes |
| Example 14 | RPES | 20 | PES | 80 | yes | yes | yes | yes |
| Example 15 | RPES | 20 | PES | 80 | yes | yes | yes | yes |
| Example 16 | RPES | 20 | PES | 80 | yes | yes | yes | yes |
| Example 17 | RPES | 20 | PES | 80 | yes | yes | yes | yes |
| Example 18 | RPES | 20 | PES | 80 | yes | yes | none | none |
| Comparative Example 1 | RPES | 20 | PES | 80 | none | none | none | none |
| Comparative Example 2 | RPES | 20 | PES | 80 | none | none | none | none |

| | Toner | | | | | |
|---|---|---|---|---|---|---|
| | Polyalkyleneimine | | | Amount | Amount of | |
| | Kind | Number average molecular weight | Amount used per 100 parts by weight of resin of particles (part by weight) | of silicone oil added per 100 parts by weight of toner particles (part by weight) | fluorine oil added per 100 parts by weight of toner particles (part by weight) | Adjusted pH of dispersion liquid |
| Example 1 | PEI | 70,000 | 1.0 | — | — | 4.0 |
| Example 2 | PEI | 70,000 | 0.5 | — | — | 4.0 |
| Example 3 | PEI | 70,000 | 0.25 | — | — | 4.0 |
| Example 4 | PEI | 70,000 | 0.125 | — | — | 4.0 |
| Example 5 | PEI | 10,000 | 1.0 | — | — | 4.0 |
| Example 6 | PEI | 1,800 | 1.0 | — | — | 4.0 |
| Example 7 | PEI | 600 | 1.0 | — | — | 4.0 |
| Example 8 | PEI | 70,000 | 1.0 | — | — | 4.0 |
| Example 9 | PEI | 70,000 | 1.0 | — | — | 4.0 |
| Example 10 | PEI | 70,000 | 1.0 | — | — | 4.0 |
| Example 11 | PEI | 70,000 | 1.0 | — | — | 4.0 |
| Example 12 | PEI | 70,000 | 1.0 | — | — | 5.8 |
| Example 13 | PEI | 70,000 | 1.0 | — | — | 3.7 |
| Example 14 | PEI | 70,000 | 1.0 | 0.5 | — | 4.0 |
| Example 15 | PEI | 70,000 | 1.0 | 2.0 | — | 4.0 |
| Example 16 | PEI | 70,000 | 1.0 | — | 0.5 | 4.0 |
| Example 17 | PEI | 70,000 | 1.0 | — | 2.0 | 4.0 |
| Example 18 | PEI | 70,000 | 1.0 | — | — | 4.0 |
| Comparative Example 1 | — | — | — | — | — | — |
| Comparative Example 2 | — | — | — | — | — | — |

(2) Production of Developing Roller

A developing roller was produced in the following manner.

A cylindrical base material formed of STKM was prepared. The base material had a length of 300 mm, an outer diameter of 18 mm and a thickness of 3 mm.

The inner peripheral portions of the base material in both end parts in the axial direction were cut by amount 1 mm to thin the thickness, and cylindrical solid column members made of STKM were press-inserted to the both end parts of the base material. The cylindrical solid column members each had a length of 50 mm and an outer diameter of 14 mm, and were press-inserted to the both end parts of the base material, whereby the column members each protruded from the end surface of the base material by about 30 mm.

Thereafter, the assembled structure of the base material and the pair of cylindrical solid column members was cut by centerless grinding, whereby the axis of the base material and the axes of the column members were conformed to each other.

A relief structure for the plural first grooves and the plural second grooves was formed on the outer circumference surface of the base material with a die made of SKD, and then hard chromium plating having a thickness of 3 μm was formed on the base material, thereby forming the relief structure constituted by the plural first grooves and the plural second grooves. The first grooves and the second grooves intersected with each other, and each were slanted from the line extending in the circumferential direction by 45°. The first grooves and the second grooves each had a pitch of 80 μm, a groove width of 26 μm and a depth of 6 μm. The depth of the groove of the first grooves and the second grooves herein is the maximum height Ry obtained by measuring the surface roughness of the developing roller according to JIS B0601-1994 with a laser microscope, VK-9500, produced by Keyence Corporation. The pitch of the groove of the first grooves and the second grooves herein is the average distance of unevenness Sm obtained by measuring the surface roughness of the developing roller according to JIS B0601-1994 with a laser microscope, VK-9500, produced by Keyence Corporation.

(3) Image Forming Apparatus

The developing roller thus produced above was installed in a color printer (LP900C, produced by Seiko Epson Corporation) to fabricate an image forming apparatus.

The spacer for controlling the developing gap had a thickness of 50 μm. The developing bias voltage was a direct current voltage of +300 V, on which a rectangular wave electric current having a peak-peak voltage of 1,000 V and a frequency of 6,000 Hz was overlapped. The other conditions were the same as those for LP9000C.

(4) Evaluation

The evaluation is performed by the following evaluation testing method and the result is shown in Table 1.

(4-1) Developing Efficiency

The toners obtained in Examples and Comparative Examples were each housed in a cartridge for the image forming apparatus as a color printer, and the toners obtained in Examples and Comparative Examples were each supported on the developing roller. The surface potential of the developing roller was adjusted to 300 V, and the surface of the photoreceptor was charged to a potential of 500 V. The photoreceptor drum was exposed to attenuate the charge of the surface of the photoreceptor drum to a surface potential of 50 V. The toner on the developing roller and the toner on the photoreceptor were collected with tapes after passing the toner supported on the developing roller through the gap between the photoreceptor drum and the developing roller. The tapes having the toners collected were adhered to recording paper, and the toner densities were measured. After measuring, a value was obtained by dividing the density of the toner collected on the photoreceptor drum by the sum of the density of the toner collected on the photoreceptor drum and the density of the toner collected on the developing roller, and the value obtained was multiplied by 100 to provide a developing efficiency, which was then evaluated according to the following standard of four grades.

A: particularly excellent developing efficiency of 96% or more

B: excellent developing efficiency of 90% or more and less than 96%

C: developing efficiency with no practical problem of 80% or more and less than 90%

D: deteriorated developing efficiency of less than 80%

(4-2) Charging Characteristics

The toners obtained in Examples and Comparative Examples were each housed in a cartridge for the image forming apparatus.

The charge amount of the toner restricted with the restricting blade of the developing device and conveyed to the photoreceptor was evaluated by analyzing with the toner on the developing roller. The charge amount was measured with E-Spart Analyzer, produced by Hosokawa Micron Co., Ltd. The measurement conditions were a suction flow rate of 0.2 L/min, a collection air flow rate of 0.6 L/min and a blowing nitrogen gas pressure of 0.02 MPa. The charge amount (Q/m) per one toner particle was measured, and the charge amount distribution was obtained from the measured values of 3,000 toner particles.

Upon evaluating the homogeneity of the charge amount of the toner, in a number distribution of the charge amount per one toner particle was obtained, an absolute value of the difference between the charge amount of the maximum frequency ($Q_1/m_1$) and a value ($Q_2/m_2$) obtained by dividing the total charge amount of the toner particles by the count (number) of the toner particles measured was obtained. When the absolute value of the difference is smaller, the charge amount distribution is more homogeneous, and when the absolute value is larger, the charge amount distribution is more heterogeneous. The absolute value of the difference was evaluated according to the following standard of five grades.

A: absolute value of difference of 0.8 or less

B: absolute value of difference of larger than 0.8 and 1.0 or less

C: absolute value of difference of larger than 1.0 and 1.5 or less

D: absolute value of difference of larger than 1.5 and 2.0 or less

E: absolute value of difference of larger than 2.0

(4-3) Rising Property of Charge 100 parts of the standard carrier, P-01 (available from the Imaging Society of Japan) and 5 parts of the toner were charged in a stainless steel pot in a test room at a temperature of 25° C. and a humidity of 50%, and rotationally mixed with a ball mill at a constant rotation number. After lapsing 15 seconds from the start of rotation, the ball mill was stopped, and the charge amount (μC/g) of the developer was measured with a blow-off device and evaluated according to the following standard of four grades.

A: charge amount of 60 μC or more

B: charge amount of larger than 50 ∞C and 60μ or less

C: charge amount of larger than 40 ∞C and 50μ or less

D: charge amount of 40 μC or less (4-1) Saturated Charge Amount under High Temperature and High Humidity Condition 100 parts of the standard carrier and 5 parts of the toner were allowed to stand in an environmental test room at a temperature of 30° C. and a humidity of 90% for one hour, then charged in a stainless steel pot in the environmental test room, and rotationally mixed with a ball mill at a constant rotation number in the environmental test room. The saturated charge amount (μC/g) of the developer after lapsing 20 minutes from the start of rotation was measured with a blow-off device. The difference between the charge amount after lapsing 1 minute and the charge amount after lapsing 20 minutes was obtained and evaluated according to the following standard of four grades.

A: difference in charge amount of ±3 μC or less

B: difference in charge amount of larger than ±3 μC and ±5 μC or less

C: difference in charge amount of larger than ±5 μC and ±7 μC or less

D: difference in charge amount of ±7 μC or more (4-5) Transferring Property

The toners of Examples and Comparative Examples were each charged in a developing device of an image forming apparatus, and the developing device was installed in the image forming apparatus A prescribed pattern (5% printing) was printed on a recording medium (A4 high quality plain paper, produced by Seiko Epson Corporation) for 50,000 sheets with the image forming apparatus, and then the fog and the scattering of the toner were evaluated according to the following standard of four grades.

The fog was evaluated in such a manner that the prescribed pattern was continuously printed on the recording medium for 10 sheets, and the extent of attachment of the toner to the non-printed part on the recording medium was visually evaluated.

A: no toner particle confirmed on non-printed part of recording medium

B: slight amount of toner particles attached to non-printed part of recording medium C: small amount of toner particles attached to non-printed part of recording medium D: large amount of toner particles attached to non-printed part of recording medium The scattering of the toner was evaluated in such a manner that in the image forming apparatus having been operated for printing in the aforementioned manner, the extent of attachment of the toner particles to the members inside the image forming apparatus was visually evaluated.

A: no toner particle confirmed on members inside image forming apparatus

B: slight amount of toner particles attached to members inside image forming apparatus C: small amount of toner particles attached to members inside image forming apparatus D: large amount of toner particles attached to members inside image forming apparatus The results obtained are shown in Table 2.

TABLE 2

| | Developing efficiency | Charging characteristics | Rising property of charge | Saturated charge amount under high temperature and high humidity condition | Fog | Scattering of toner |
|---|---|---|---|---|---|---|
| Example 1 | A | B | A | A | A | A |
| Example 2 | A | B | A | A | A | A |
| Example 3 | B | B | B | A | B | B |
| Example 4 | B | C | B | A | C | C |
| Example 5 | A | B | A | A | B | B |
| Example 6 | B | C | B | A | C | C |
| Example 7 | B | C | B | A | C | C |
| Example 8 | A | B | A | A | A | A |
| Example 9 | A | B | A | A | A | A |
| Example 10 | A | B | A | A | A | A |
| Example 11 | A | B | A | A | A | A |
| Example 12 | C | C | C | A | C | C |
| Example 13 | B | C | C | B | C | C |
| Example 14 | A | A | A | A | A | A |
| Example 15 | A | A | A | A | A | A |
| Example 16 | A | A | A | A | A | A |
| Example 17 | A | A | A | A | A | A |
| Example 18 | C | C | C | C | C | C |
| Comparative Example 1 | D | E | D | D | D | D |
| Comparative Example 2 | D | D | D | D | D | D |

It was understood from Table 2 that Examples according to the aspects of the invention exhibited high developing efficiency and excellent charging characteristics. In particular, Examples 14 to 17, in which a silicone oil or a fluorine oil was added, exhibited particularly high developing efficiency and excellent charging characteristics. On the other hand, Comparative Examples failed to provide satisfactory results.

The entire disclosure of Japanese Patent Application No. 2008-187235, filed Jul. 18, 2008 is expressly incorporated by reference herein.

What is claimed is:

1. A black toner comprising: toner mother particles containing carbon black as a colorant and a binder resin, the toner mother particles being surface-modified with a polyalkyleneimine, wherein the binder resin contains a rosin resin.

2. The black toner as claimed in claim 1, wherein the polyalkyleneimine is polyethyleneimine.

3. The black toner as claimed in claim 1, wherein the polyalkyleneimine has a number average molecular weight of from 5,000 to 100,000.

4. The black toner as claimed in claim 1, wherein the rosin resin has a softening point of from 80 to 190° C.

5. The black toner as claimed in claim 1, wherein the rosin resin has a weight average molecular weight of from 500 to 100,000.

6. An image forming method using a black toner, comprising forming an image with an image forming apparatus through charging, exposing, developing, transferring and fixing, the black toner comprising: toner mother particles containing carbon black as a colorant and a binder resin, the toner mother particles being surface-modified with a polyalkyleneimine, wherein the binder resin contains a rosin resin.

7. The image forming method as claimed in claim 6, wherein the image forming apparatus comprising:

a latent image supporting member that supports a latent image, and a developing device that applies the black toner to the latent image supporting member to visualize the latent image as a toner image, the developing device containing:

a toner housing part that houses the black toner, and a developing roller that faces the latent image supporting member adjacently and has a relief structure on an outer circumference surface thereof for supporting the black toner, the relief structure being formed by a rolling method.

* * * * *